US007260541B2

(12) United States Patent
Tsushima et al.

(10) Patent No.: US 7,260,541 B2
(45) Date of Patent: Aug. 21, 2007

(54) AUDIO SIGNAL DECODING DEVICE AND AUDIO SIGNAL ENCODING DEVICE

(75) Inventors: Mineo Tsushima, Katano (JP); Takeshi Norimatsu, Kobe (JP); Naoya Tanaka, Neyagawa (JP); Kosuke Nishio, Moriguchi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 581 days.

(21) Appl. No.: 10/363,820

(22) PCT Filed: Jul. 11, 2002

(86) PCT No.: PCT/JP02/07081

§ 371 (c)(1),
(2), (4) Date: Mar. 7, 2003

(87) PCT Pub. No.: WO03/007480

PCT Pub. Date: Jan. 23, 2003

(65) Prior Publication Data

US 2004/0028244 A1 Feb. 12, 2004

(30) Foreign Application Priority Data

Jul. 13, 2001 (JP) ..... 2001-213378

(51) Int. Cl.
*G10L 11/06* (2006.01)

(52) U.S. Cl. ..... 704/500; 704/214

(58) Field of Classification Search ..... 704/214, 704/500–504

See application file for complete search history.

(56) References Cited

U.S. PATENT DOCUMENTS 4,610,022 A * 9/1986 Kitayama et al. ..... 704/205
5,651,092 A * 7/1997 Ishii et al. ..... 704/226
6,128,591 A * 10/2000 Taori et al. ..... 704/214

FOREIGN PATENT DOCUMENTS

| | | |
|---|---|---|
| JP | 05-019798 | 1/1993 |
| JP | 5-19798 | 1/1993 |
| JP | 08-330971 | 12/1996 |
| JP | 8-330971 | 12/1996 |
| JP | 10-126272 | 5/1998 |
| WO | 98/57436 | 12/1998 |

OTHER PUBLICATIONS

ISO/IEC JTC1/SC29/WG11 IS 13818-7, "Information technology—Generic coding of moving pictures and associated audio information", Part 7: Advanced Audio Coding (AAC), First edition Dec. 1, 1997.

(Continued)

*Primary Examiner*—Brian T. Pendleton
(74) *Attorney, Agent, or Firm*—Wenderoth, Lind & Ponack, L.L.P.

(57) ABSTRACT

A decoding device is a decoding device that generates frequency spectral data from an inputted encoded audio data stream, and includes: a core decoding unit for decoding the inputted encoded data stream and generating lower frequency spectral data representing an audio signal; and an extended decoding unit for generating, based on the lower frequency spectral data, extended frequency spectral data indicating a harmonic structure, which is same as an extension along the frequency axis of the harmonic structure indicated by the lower frequency spectral data, in a frequency region which is not represented by the encoded data stream.

10 Claims, 17 Drawing Sheets

OTHER PUBLICATIONS

Co-pending U.S. Appl. No. 10/140,881, filed May 9, 2002, entitled "*Encoding Device, Decoding Device, and Broadcast System*".

Co-pending U.S. Appl. No. 10/285,609, filed Nov. 1, 2002, entitled "*Encoding Device and Decoding Device*".

Co-pending U.S. Appl. No. 10/285,627, filed Nov. 1, 2002, entitled "*Encoding Device, Decoding Device, and Audio Data Distribution System*".

Co-pending U.S. Appl. No. 10/285,633, filed Nov. 1, 2002, entitled "*Encoding Device Decoding Device*".

* cited by examiner t

Amplitude
f

Band M
Band K
Band O
Higher frequency region
Lower frequency region
t

AUDIO SIGNAL DECODING DEVICE AND AUDIO SIGNAL ENCODING DEVICE

TECHNICAL FIELD

The present invention relates to encoding devices for compressing data by encoding signals obtained by transforming audio signals such as sound and music signals in the time domain into those in the frequency domain with a smaller amount of encoded data stream, using a method such as an orthogonal transform, and decoding devices for expanding the data upon receipt of the encoded data stream.

BACKGROUND ART

A great many methods of encoding and decoding audio signals have been developed up to now. Particularly, in these days, IS13818-7 which is internationally standardized in ISO/IEC is publicly known and highly appreciated as an encoding method for reproducing high quality sound with high efficiency. This encoding method is called AAC. In recent years, the AAC has been adopted to the standard called MPEG-4, and a system called MPEG-4 AAC that has some extended functions added to the IS13818-7 has been developed. An example of the encoding procedure is described in the informative part of the MPEG-4 AAC.

Following is an explanation for an audio encoding device using the conventional encoding method referring to FIG. 1. FIG. 1 is a block diagram that shows the structure of a conventional encoding device 300. The encoding device 300 includes a spectrum amplifying unit 301, a spectrum quantizing unit 302, a Huffman coding unit 303 and an encoded data stream transfer unit 304. A discrete audio signal stream on the time axis obtained by sampling an analog audio signal at a predetermined frequency is divided into every predetermined number of samples at a predetermined time interval, transformed into data on the frequency axis through a time-frequency transforming unit not shown here, and then given to the spectrum amplifying unit 301 as an input signal into the encoding device 300. The spectrum amplifying unit 301 amplifies a spectrum included in every predetermined band with one certain gain. The spectrum quantizing unit 302 quantizes the amplified spectrum with a predetermined transform expression. In the case of AAC method, the quantization is conducted by rounding off frequency spectral data which is expressed in floating points into an integer value. The Huffman coding unit 303 encodes the quantized spectral data in a set of certain pieces thereof according to Huffman coding, and encodes the gain in every predetermined band in the spectrum amplifying unit 301 and the data that specifies the transform expression for the quantization according to Huffman coding, and then transmits the codes of them to the encoded data stream transfer unit 304. The Huffman-coded data stream is transferred from the encoded data stream transfer unit 304 to a decoding device via a transmission channel or a recording medium, and reconstructed as an audio signal on the time axis by the decoding device. The conventional encoding device operates as described above.

In the conventional encoding device 300, a capability for compressing data amount depends on the performance of the Huffman coding unit 303 or the like, so when the encoding is conducted at a high compression rate, that is, with a small amount of data, it is necessary to reduce the gain sufficiently in the spectrum amplifying unit 301 and encode the quantized spectrum stream obtained by the spectrum quantizing unit 302 so as to make it a smaller amount of data in the Huffman coding unit 303. However, if the conventional encoding device 300 structured as above encodes with the smaller amount of data, the frequency bandwidth for reproduced sound and music becomes narrow. So it cannot be denied that the sound and music would be fuzzy for human hearing. As a result, it is impossible to maintain the sound quality. That is a problem.

The present invention is devised in view of the above-mentioned problem, and aims at providing an audio signal encoding device and an audio signal decoding device capable of decoding wide-band frequency spectral data with a small amount of data.

SUMMARY OF THE INVENTION

The decoding device according to the present invention is a decoding device that generates frequency spectral data from an inputted encoded audio data stream, the decoding device comprising: a core decoding unit operable to decode the inputted encoded data stream and generate first frequency spectral data representing an audio signal; and an extended decoding unit operable to generate, based on the first frequency spectral data, second frequency spectral data in a frequency region which is not represented by the encoded data stream, the second frequency spectral data indicating a harmonic structure which is same as an extension along a frequency axis of a harmonic structure indicated by the first frequency spectral data. The decoding device according to the present invention generates from the inputted encoded audio data stream the second frequency spectral data having the harmonic structure indicated by the first frequency spectral data in the frequency region which is not represented by the encoded data stream. Accordingly, the decoding device according to the present invention can provide a wide-band encoded audio data stream even when it receives, via a transmission channel for a low bit rate, a narrow-band encoded audio data stream whose data amount is reduced. Also, since the higher second frequency spectral data is generated from the lower first frequency spectral data based on a harmonic structure an audio signal inherently has, there is an effect that a wide-band audio signal can be reproduced with more natural sound quality for human hearing.

Also, the decoding device according to the present invention is a decoding device that generates frequency spectral data from an inputted encoded audio data stream, the decoding device comprising: a core decoding unit operable to decode the inputted encoded data stream and generate first frequency spectral data representing an audio signal; an extended decoding unit operable to decode, out of the inputted encoded data stream, data on an amplitude indicated by frequency spectral data representing an audio signal in a frequency region extended along a frequency axis from the first frequency spectral data; and a harmonic generating unit operable to generate, based on the data on the amplitude, second frequency spectral data in a frequency region which is not represented by the encoded data stream, the second frequency spectral data indicating a harmonic structure which is same as an extension along the frequency axis of a harmonic structure indicated by the first frequency spectral data. The decoding device according to the present invention acquires, as a part of the encoded data stream, the data on the amplitude obtained by analyzing the frequency spectral data that is the audio signal itself in the frequency band which is not encoded by the core encoding unit of the encoding device, and generates the second frequency spectral data having the harmonic structure indicated by the first frequency spectral data based on the data on the amplitude. Accordingly, since the second frequency spectral data having the harmonic structure closer to the original sound can be generated in the higher frequency region, there is an effect that a wider-band audio signal can be reproduced with more natural sound quality for human hearing.

Furthermore, the decoding device according to the present invention is a decoding device that generates frequency spectral data from an inputted encoded audio data stream, the decoding device comprising: a core decoding unit operable to decode the inputted encoded data stream and generate first frequency spectral data, the first frequency spectral data being an audio time-frequency signal representing by every frequency bandwidth a time transition of frequency spectral data belonging to a frequency bandwidth which is outputted from a polyphase filter bank; and an extended decoding unit operable to generate, based on the time-frequency signal that is a frequency component of the first frequency spectral data, second frequency spectral data in a frequency region which is not represented by the encoded data stream, the second frequency spectral data being a time-frequency signal in the frequency region and indicating time cyclicity of the first frequency spectral data. Accordingly, the decoding device according to the present invention produces an effect that an audio signal which responds to an abrupt change and vibration of the original sound as well as a wide-band audio signal can be reproduced.

In addition, the encoding device according to the present invention is an encoding device that generates an encoded data stream from frequency spectral data of an audio signal, the encoding device comprising: a core encoding unit operable to encode the inputted frequency spectral data and generate an encoded audio data stream; and an extended encoding unit operable to encode, out of the inputted frequency spectral data, data on an amplitude of frequency spectral data in a frequency region which is not encoded by the core encoding unit. The encoding device according to the present invention does not encode the spectrum in the higher frequency region but mainly encodes only the data on the average amplitude of the spectrum. Therefore, there is an effect of reducing the data amount occupied by the spectrum in the higher frequency region of the encoded bit stream.

BEST MODE FOR CARRYING OUT THE INVENTION

THE FIRST EMBODIMENT

Figure 1:
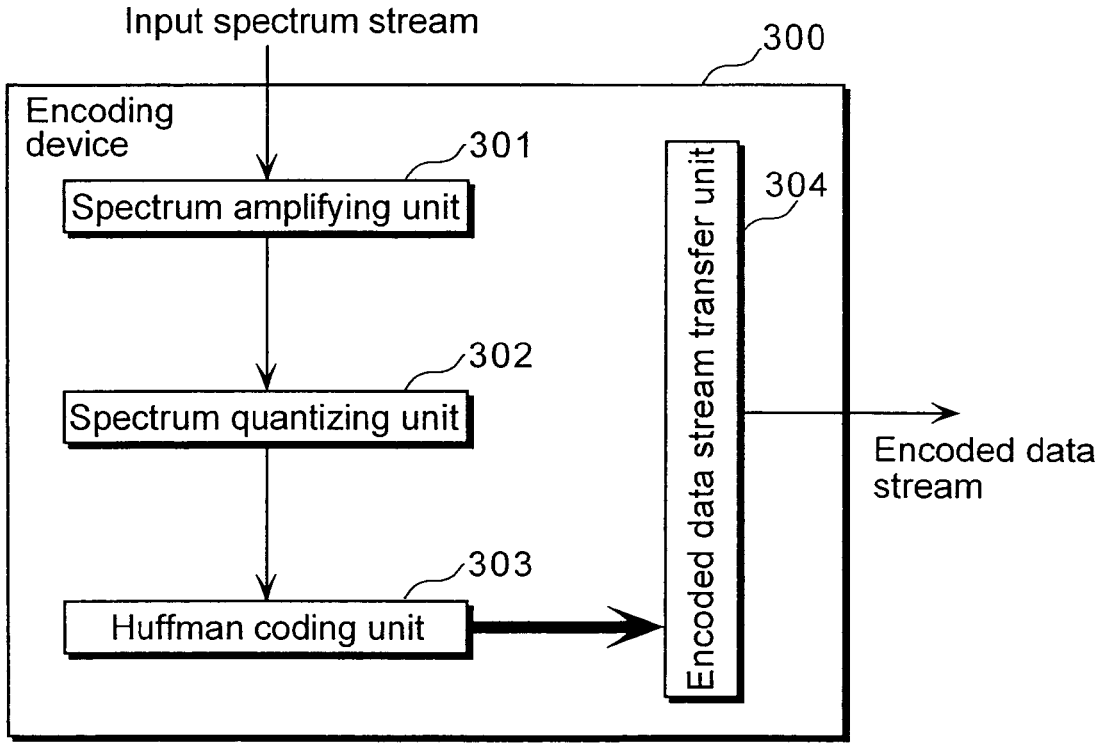
FIG. 1 is a block diagram showing the structure of the conventional encoding device.
Figure 2:
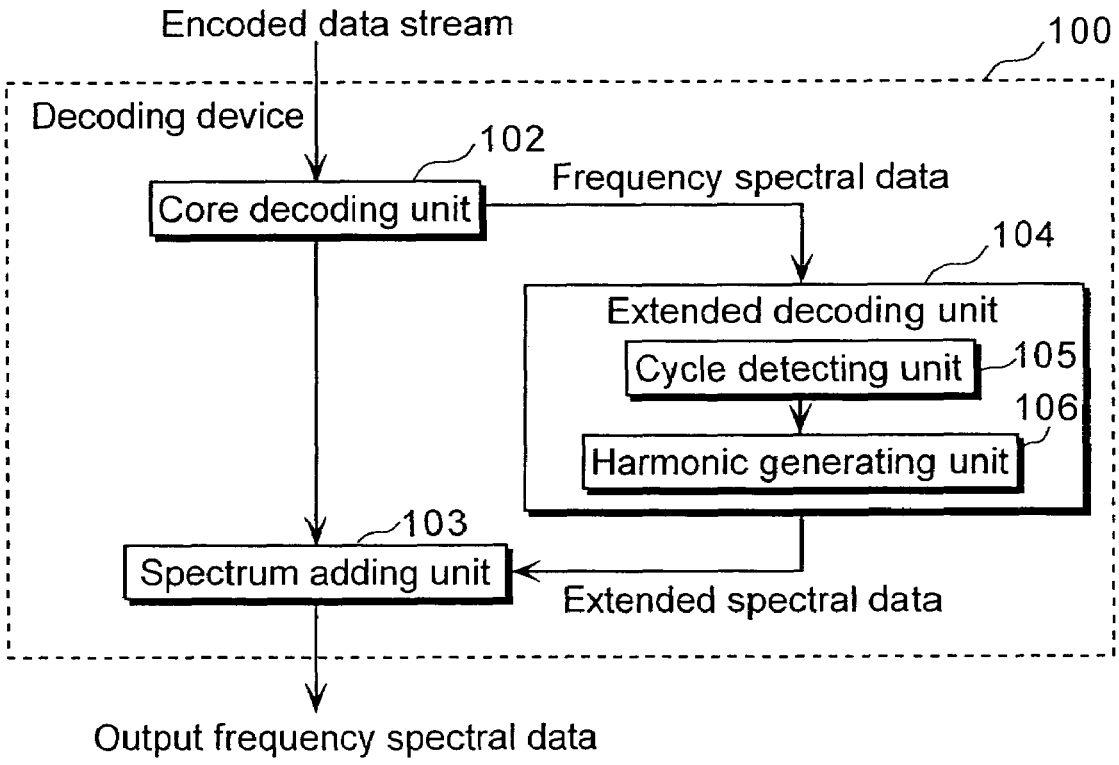
FIG. 2 is a block diagram showing the structure of a decoding device according to a first embodiment of the present invention.

The decoding devices and the encoding devices according to the embodiments of the present invention will be explained in detail with reference to figures. FIG. 2 is a block diagram showing the structure of a decoding device 100 according to the first embodiment of the present invention. The decoding device 100 is a decoding device that receives a data stream encoded by the conventional encoding device 300 and reconstructs wider-band frequency spectral data than the bandwidth represented by the encoded data stream. The decoding device 100 includes a core decoding unit 102, a spectrum adding unit 103 and an extended decoding unit 104. The extended decoding unit 104 includes a cycle detecting unit 105 and a harmonic generating unit 106. The core decoding unit 102 decodes the lower frequency spectral data represented by the input encoded data stream. The spectrum adding unit 103 adds the lower frequency spectral data outputted from the core decoding unit 102 and the higher extended spectral data outputted from the extended decoding unit 104 on the frequency axis, and generates the output frequency spectral data. The extended decoding unit 104 analyzes the harmonic structure of the lower frequency spectral data outputted from the core decoding unit 102 for detecting the harmonic cycle of the lower frequency spectral data, and generates the extended spectral data having the detected harmonic cycle in the higher frequency region.

The core decoding unit 102 decodes the input encoded data stream generated as above. The input encoded data stream represents the amplitude data of the frequency spectral data which is quantized in every band, the phase data of each frequency spectral data, a coefficient corresponding to the average amplitude of each band (band gain) and the like. The core decoding unit 102 decodes (executes inverse Huffman coding of) the input encoded data stream, performs an operation on the amplitude data in every band obtained as a result of the decoding using the coefficient of the band, and adds the phase data to each frequency spectral data, for reconstructing the frequency spectral data as a whole. The frequency spectral data obtained as a result of the decoding by the core decoding unit 102 is inputted to the spectrum adding unit 103 and the extended decoding unit 104.

Here, the case will be explained as an example, where the encoded data stream inputted to the present decoding device 100 is in conformity with the ISO/IEC 13818-7 (MPEG-2 AAC) method. In the encoding device 300, a discrete audio signal obtained by sampling at a predetermined sampling frequency (44.1 kHz, for instance) is divided into a predetermined number of samples (hereinafter referred to as "a frame") at a predetermined time interval. The samples in each frame are transformed from the discrete signal on the time axis into the frequency spectral data according to time-frequency transform. As the time-frequency transform, a method such as MDCT (Modified Discrete Cosine Transform) is generally used, and the transform is performed at a time interval of every 128, 256, 512, 1024 or 2048 samples for one frame. When MDCT is used as the time-frequency transform, the number of samples of the discrete signal on the time axis can be identified with the number of samples of the frequency spectral data obtained after the transform. Furthermore, the frequency spectral data as the result of the transform in each frame is grouped into one band in every predetermined bandwidth including a plurality of the frequency spectral data, amplified and quantized by every band, and then encoded according to Huffman coding, so as to be outputted.

The discrete audio signal on the time axis can be obtained from the frequency spectral data obtained by the decoding by the core decoding unit 102 according to the frequency-time transform, for instance, IMDCT (Inverse Modified Discrete Cosine Transform). The frequency spectral data reconstructed by the core decoding unit 102 is MDCT coefficients described in the process of decoding according to MPEG-2 AAC. As described above, the frequency spectral data obtained by the core decoding unit 102 represents an audio signal mainly in the lower frequency region, which is similar bandwidth of the frequency spectral data obtained by the conventional decoding device. In order to simplify the explanation, the case will be described as an example, where the frequency spectral data obtained by the core decoding unit 102 has the reproduction frequency bandwidth of 11.025 kHz (i.e., 512 samples in the higher frequency region is omitted), while the discrete audio signal inputted into the encoding device 300 has been originally sampled by every 1,024 samples at the sampling frequency of 44.1 kHz (i.e., the signal has the reproduction frequency bandwidth of 22.05 kHz).

Figure 3:
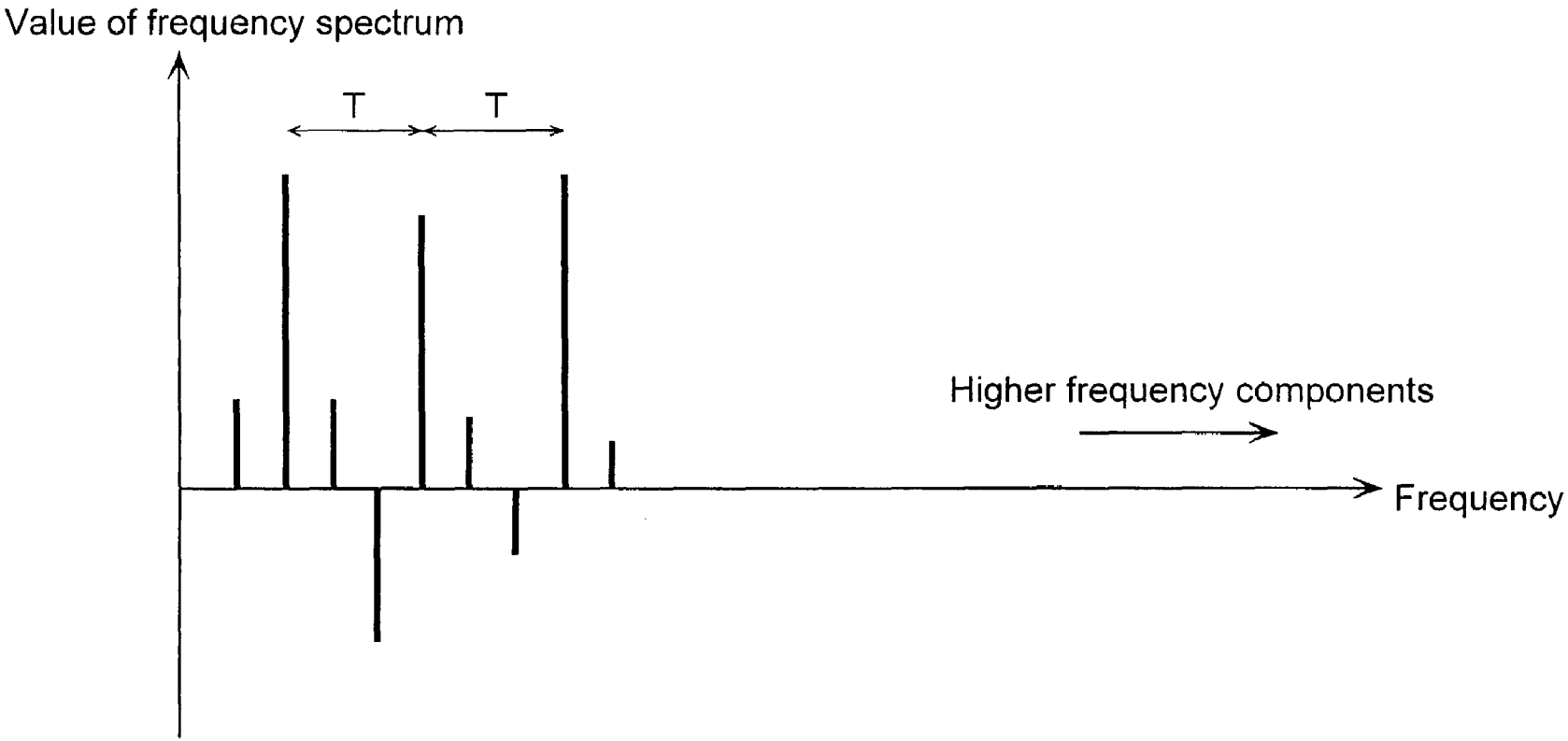
FIG. 3 is a diagram showing schematically the harmonic structure of audio frequency spectral data in the lower frequency region.

The extended decoding unit 104 analyzes the inputted lower frequency spectral data for extracting the harmonic structure, and generates the extended spectral data indicating the harmonic in the higher frequency region which is an extension of the spectrum reconstructed by the core decoding unit 102. Note that the extended spectral data which is generated in the higher frequency region by the extended decoding unit 104 does not always need to be 512 samples. The cycle detecting unit 105 included in the extended decoding unit 104 detects the cycle of the harmonic structure included in the lower frequency spectral data decoded by the core decoding unit 102. The harmonic generating unit 106 adjusts the phase of the harmonic having the cycle detected by the cycle detecting unit 105 so that the harmonic maintains continuity with the harmonic components of the lower frequency spectral data, and then generates the higher frequency spectral data. Operation of the extended decoding unit 104 will be explained below in more detail using FIG. 3. FIG. 3 is a diagram showing schematically a harmonic structure of audio frequency spectral data in the lower frequency region. In this figure, the horizontal axis indicates frequency values, and the vertical axis indicates frequency spectral data values. Generally speaking, in a lot of sound sources, local peaks of frequency spectral amplitude are observed at frequencies of integral multiples, a double, triple or quadruple harmonic, for instance, of a basic frequency component, when an audio signal is seen as a frequency spectrum. As shown in this figure, the local peaks of the frequency spectral data are observed at every predetermined frequency interval (e.g., a harmonic cycle) "T". Assuming that the peak interval of the frequency spectral data observed in the lower frequency components is also repeated in the higher frequency region based on this characteristic, the extended decoding unit 104 generates the extended spectral data.

First, the extended decoding unit 104 calculates the harmonic cycle "T" based on the lower frequency spectral data that is the output of the core decoding unit 102, using Expression 1 or the like. Expression 1 is an expression for calculating the cyclicity of the frequency spectral data "sp(j)". In Expression 1, "sp(j)" is a value of frequency spectral data at a frequency "j", and "Cor(i)" as a calculation result is the "i"th auto-correlation value. In this Expression 1, the ordinal numbers "i" and "j" are both integers, $0 \leqq j \leqq 511$ and $1 \leqq i \leqq 511$, respectively.

$$Cor(i) = \sum_j sp(j) * sp(j-i) \qquad \text{Expression 1}$$

In Expression 1, "i" in the case where the value of the auto-correlation function "Cor(i)" is large gives the harmonic cycle "T" of the frequency spectral data "sp(j)". More specifically, in the above example, the auto-correlation function "Cor(i)" is the sum of the products of the "j"th frequency spectral data "sp(j)" and the (j-i)th frequency spectral data "sp(j-i)" obtained by varying the integer "j" in the range of $0 \leqq j \leqq 511$. Under this condition, when the value of the correlation function "Cor(i)" is large for an integer "i", the frequency spectral data "sp(j)" has a cyclicity of an interval for every "i" pieces of frequency spectral data. This ordinal number "i" may be not only the value in the case where the value of the auto-correlation function "Cor(i)" is maximum but also a plurality of values. For example, when the extended decoding unit 104 generates a several types of harmonics with different basic sounds in the higher frequency region, a plurality of values "i" may be used for the larger value of the auto-correlation function "Cor(i)". The cycle detecting unit 105 detects the harmonic cycle "T" included in the lower frequency spectral data using Expression 1.

Figure 4:
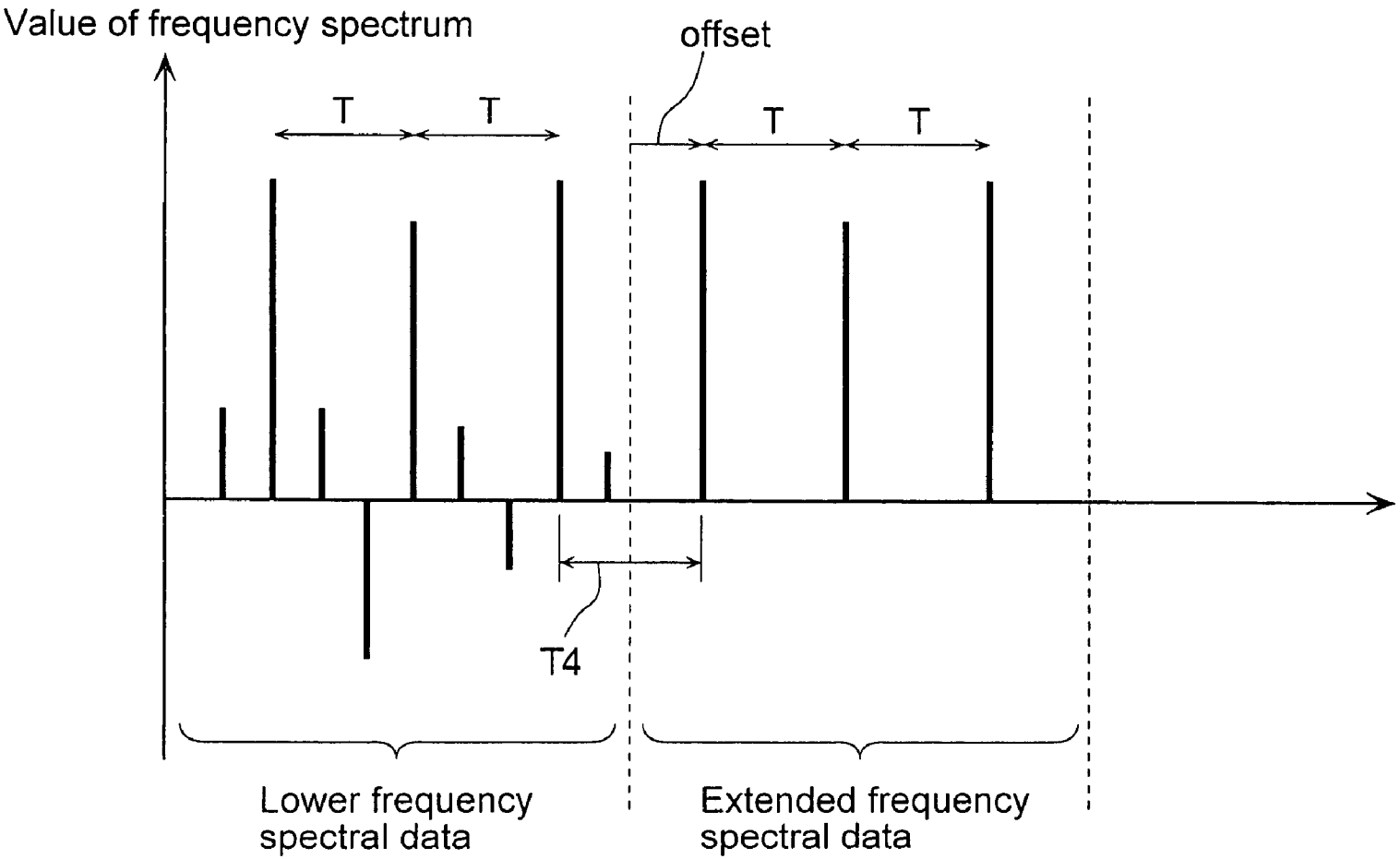
FIG. 4 is a diagram showing schematically the output frequency spectral data of the decoding device shown in FIG. 2.

Next, the harmonic generating unit 106 determines at which phase component of the waveform of the harmonic cycle "T" the extended spectral data which is to be generated in the higher frequency region starts. FIG. 4 is a diagram showing schematically the output frequency spectral data of the decoding device 100 shown in FIG. 2. As shown in FIG. 4, the harmonic generating unit 106 sets an offset of the extended spectral data so that the time interval "T4" between the last local peak of the lower frequency spectral data decoded by the core decoding unit 102 and the first local peak of the extended spectral data generated by the core decoding unit 104 becomes equal to the harmonic cycle "T". The harmonic generating unit 106 further amplifies the lower frequency spectral data having the harmonic cycle "T" calculated as above with a predetermined gain, and sets the above-mentioned offset so as to generate the extended spectral data in the higher frequency region. The spectral adding unit 103 adds the lower frequency spectral data decoded by the core decoding unit 102 and the higher extended spectral data generated by the extended decoding unit 104 on the frequency axis so as to generate wide-band output frequency spectral data shown in FIG. 4.

According to the decoding device 100 structured as above in the first embodiment, a harmonic structure, which is a relatively typical characteristic of an audio signal, is extracted within the bandwidth represented by the encoded data stream and the extended spectral data is additionally reconstructed in the higher frequency region although the bandwidth of the input encoded data stream is narrow. Therefore, wider-band sound which is relatively natural for human hearing can be reproduced.

In the first embodiment, the case has been explained, where the encoded data stream inputted into the present decoding device 100 is encoded according to MPEG-2 AAC. However, the encoded data stream inputted into the decoding device 100 is not limited to that encoded according to MPEG-2 AAC, but may be encoded according any other audio encoding method.

Figure 5:
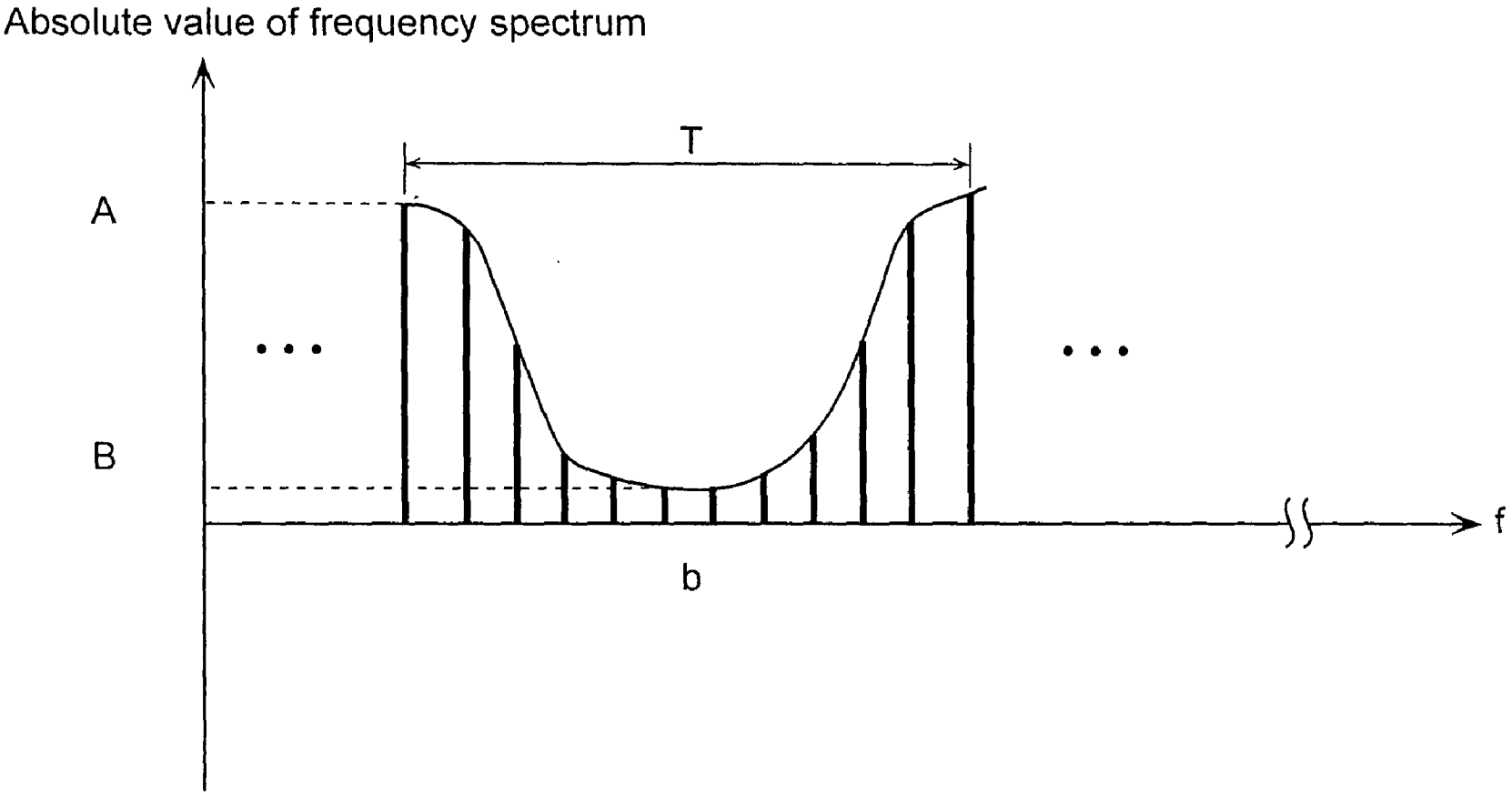
FIG. 5 is a diagram showing another method of extracting the harmonic structure from lower frequency spectral data which is decoded by a core decoding unit shown in FIG. 2.
Figure 6:
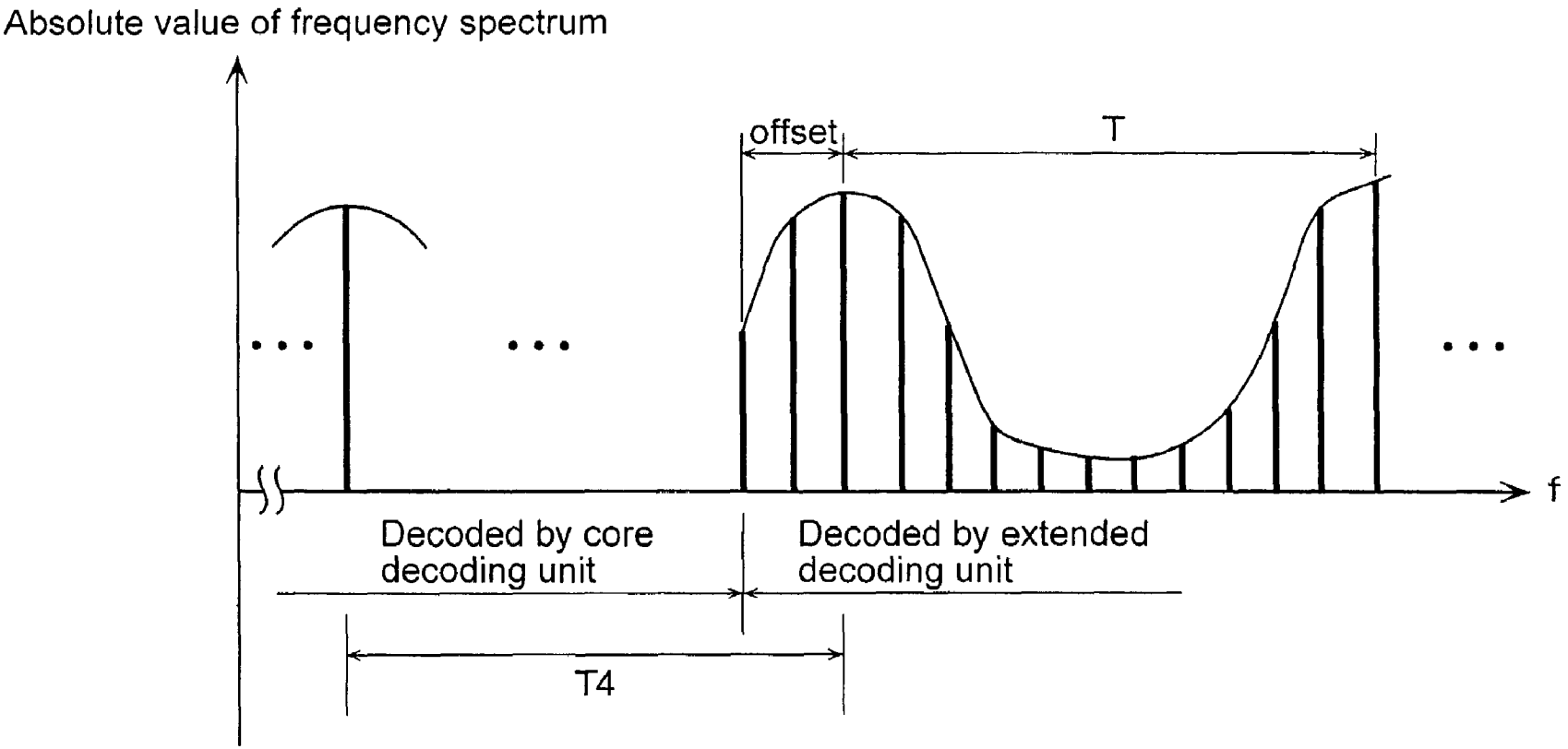
FIG. 6 is a diagram showing schematically extended spectral data which is generated using the harmonic structure extracting method shown in FIG. 5.

In the first embodiment, the harmonic cycle "T" of the lower frequency spectral data is calculated using an auto-correlation function, but the present invention is not limited to this, and the harmonic structure of the lower frequency spectral data may be extracted using any other method. FIG. 5 is a diagram showing another method of extracting the harmonic structure from the lower frequency spectral data decoded by the core decoding unit 102 shown in FIG. 2. For example, as for energy of frequency spectral data, it is assumed that the energy distribution can be represented with a function at a harmonic cycle "T". Here, it is a cosine function or the like. When it is a cosine function, the energy distribution is a waveform with the maximum value "1" and the minimum value "0". However, in this example, a function $f(C)=(A-B)\cos C+B$ is used, in which the maximum value is "A" and the minimum value is "B". In this function f(C), "C" is an angular frequency corresponding to a harmonic cycle "T". In the lower frequency spectral data decoded by the core decoding unit 102, the coefficient B is extracted from the amplitude value corresponding to the valley b (the midpoint between a peak and the adjacent peak) of the waveform of the harmonic cycle "T", and the coefficient A is extracted from the amplitude value corresponding to the peak thereof, and thereby the ratio of "A" and "B" can be calculated. FIG. 6 is a diagram showing schematically extended spectral data which is generated using the harmonic structure extracting method shown in FIG. 5. As shown in this figure, when determining the cosine function $f(C)=(A-B)\cos C+B$ which represents the energy distribution of the lower frequency spectral data, the extended decoding unit 104 amplifies in the higher frequency region the frequency spectral data represented by the cosine function with a predetermined gain, and generates the extended spectral data by setting offset in the same manner as the first embodiment. In this case, the lower frequency spectral data in one harmonic cycle "T" may be repeated for copying in the higher frequency region, or may be amplified with a predetermined gain and used for copying. Or, the frequency spectral data may be amplified with a gain which varies in every harmonic cycle "T" and used for copying.

In the above-mentioned first embodiment, the analog audio signal which is sampled at a sampling frequency of 44.1 kHz is divided into every 1,024 samples, time-frequency transformed at a time, quantized and encoded so as to obtain an encoded data stream, and, out of this obtained entire data stream, the encoded data stream for 512 samples in the lower frequency region is inputted into the decoding device 100. However, the present invention is not limited to this, the sampling frequency, the number of samples to be divided, the number of samples which are time-frequency transformed at a time and the like may be any other values. Also, the first embodiment has been explained on the assumption that the encoded data stream inputted into the decoding device 100 is 512 samples, but the present invention is not limited to this case in either the number of samples or the transmission band. The bandwidth represented by the input encoded data stream does not need to be a continuous band from the lower through the higher region, but may be discrete bands. In addition, the number of samples represented by the input encoded data stream does not need to be 512, but may be more or less.

THE SECOND EMBODIMENT

Figure 7:
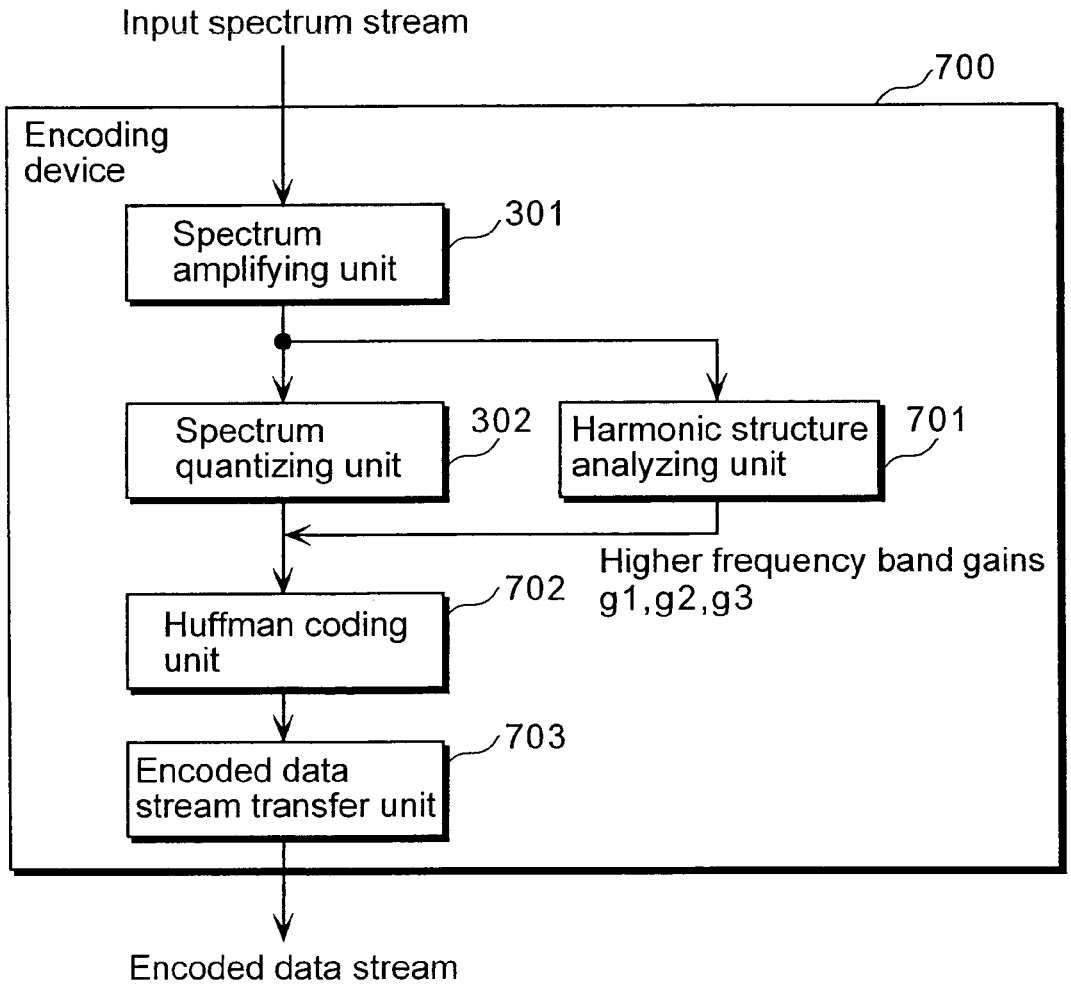
FIG. 7 is a block diagram showing the structure of an encoding device according to a second embodiment.

In the second embodiment, an encoding device analyzes the harmonic structure of frequency spectral data in advance, and stores for transmission the analysis result, that is, parameters indicating the harmonic structure in an area in the encoded bit stream which is not recognized as an audio signal by the conventional decoding device. FIG. 7 is a block diagram showing the structure of an encoding device 700 according to the second embodiment. The encoding device 700 includes the spectrum amplifying unit 301, the spectrum quantizing unit 302, a harmonic structure analyzing unit 701, a Huffman coding unit 702 and an encoded data stream transfer unit 703. In this encoding device 700, the spectrum amplifying unit 301 and the spectrum quantizing unit 302 are same as those in the conventional encoding device 300 and have been already explained, so the explanation thereof will be omitted. The harmonic structure analyzing unit 701 analyzes the frequency spectral data amplified by every band by the spectrum amplifying unit 301, and extracts the harmonic structure of the frequency spectral data in the higher frequency region. The extracted harmonic structure is a band gain g1, g2 or g3 of each band in the higher frequency region. The harmonic structure analyzing unit 701 represents the extracted harmonic structure by parameters and outputs them to the Huffman coding unit 702.

Here, there are some methods in which the harmonic structure analyzing unit 701 extracts a harmonic structure. When the spectrum amplifying unit 301 amplifies the frequency spectral data in the bandwidth including the higher frequency region, the band gain g1, g2 or g3 in each band of the higher frequency region used by the spectrum amplifying unit 301 may be used as it is. When the spectrum amplifying unit 301 does not perform processing for the higher frequency region, the band gains for the lower frequency region may be used as they are, or band gains multiplied by coefficients may be used. Or the average value of band gains for some bands in the lower frequency region may be the band gain g1, g2 or g3 for each band in the higher frequency region. The Huffman coding unit 702 encodes according to Huffman-coding the amplitude data and phase data of the quantized lower frequency spectral data inputted from the spectrum quantizing unit 302 and the band gain for each band, and encodes the parameters inputted from the harmonic structure analyzing unit 701 for outputting to the encoded data stream transfer unit 703. The encoded data stream transfer unit 703 transforms the encoded data stream inputted from the Huffman coding unit 303 into an encoded bit stream in a format for transfer defined by the standard and then transfers it. More specifically, the encoded data stream transfer unit 703 stores the encoded data stream obtained by Huffman-coding the lower frequency spectral data from the spectrum quantizing unit 302, in an area of the encoded bit stream where an audio encoded data stream is stored, and further stores the encoded data stream obtained by Huffman-coding the parameters from the harmonic structure analyzing unit 701, in an area of the audio encoded data stream which is not recognized as an audio encoded data stream by the conventional decoding device 100 or an area where the processing by the decoding device for the data in that area is not defined, and outputs it as an encoded bit stream to a transmission channel or a recording medium.

Figure 8:
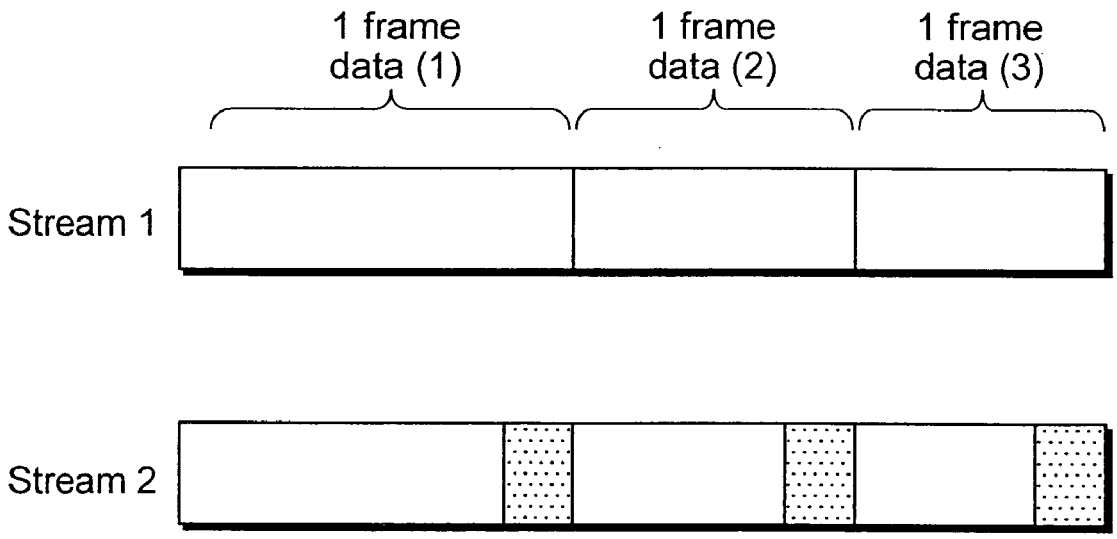
FIG. 8 is a diagram showing encoded bit streams outputted by an encoded data stream transfer unit of the encoding device shown in FIG. 7.

FIG. 8 is a diagram showing encoded bit streams outputted by the encoded data stream transfer unit 703 of the encoding device 700 shown in FIG. 7. As shown in the stream 1 of FIG. 8, when the encoded bit stream is made up of one frame data (1)~one frame data (3) which are respectively used for decoding one frame, the encoded data stream transfer unit 703 allocates a portion (a dotted portion) of each frame data for storing the analysis results by the harmonic structure analyzing unit 701, as shown in the stream 2, for making up the encoded bit stream. According to MPEG-2 AAC, the dotted portion in the encoded bit stream 2 corresponds to "fill_element( )" in "raw_data_block( )" described in the standard. In the decoding device according to MPEG-2 AAC, "fill_element( )" is an area which is usually skipped. Therefore, even if the decoding device according to MPEG-2 AAC decodes the bit stream encoded by the encoding device 700, there is no influence on reproduced sound, so an audio signal can be reproduced without any problem. On the other hand, if the extended decoding unit of the decoding device in the second embodiment reads out "fill_element( )" in the encoded bit stream for decoding, wide-band audio sound can be reproduced.

The encoded bit stream according to MPEG-2 AAC has been described here, but that according to MPEG-4 AAC is the same. Also, according to ISO/IEC 11172-3 (MPEG-1 LAYER 3 method), if a stream decoded by the extended decoding unit is encoded in "ancillary_data( )", the same effect as MPEG-2 AAC can be expected. The same applies to MPEG-2 LAYER 3. The structure of the encoded data stream as described above makes it possible to obtain reproduced sound without any problem even in the method having only an ordinary core decoding unit for decoding, and obtain wide-band reproduced sound in the decoding device having the extended decoding unit.

Figure 9:
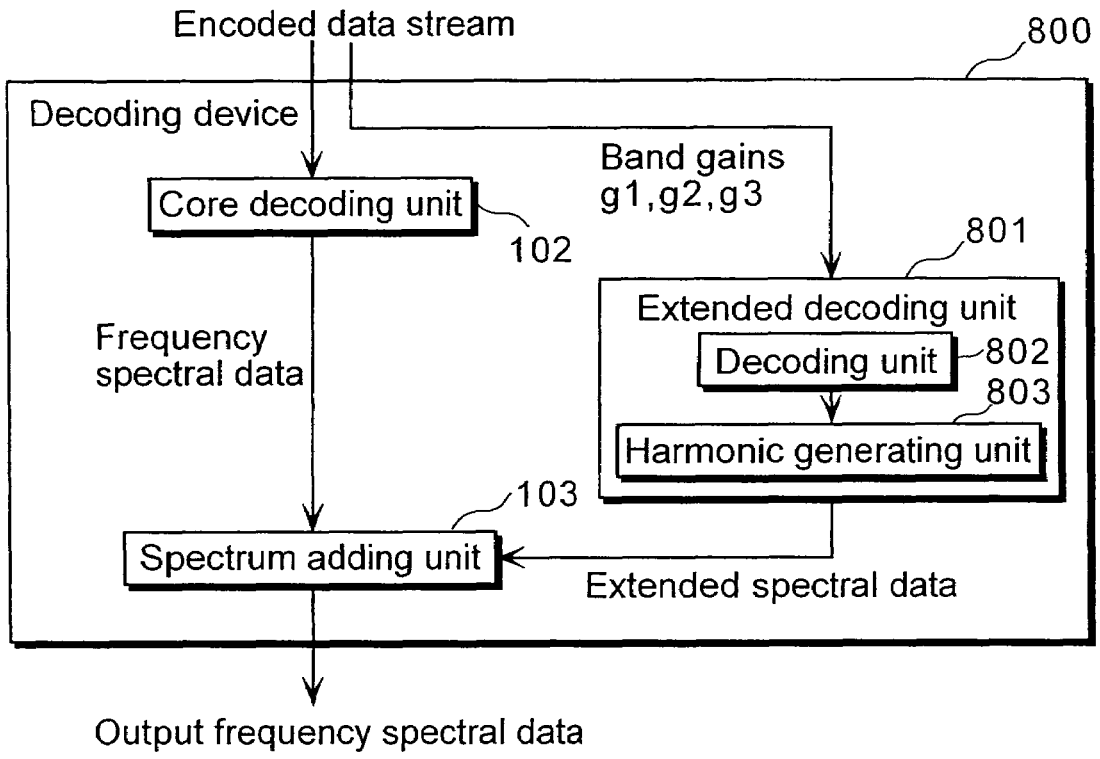
FIG. 9 is a block diagram showing the structure of a decoding device according to the second embodiment.

FIG. 9 is a block diagram showing the structure of a decoding device 800 according to the second embodiment. The decoding device 800 includes the core decoding unit 102, an extended decoding unit 801 and the spectrum adding unit 103. The extended decoding unit 801 further includes a decoding unit 802 and a harmonic generating unit 803. The decoding device 800 is different from the decoding device 100 in the first embodiment in that not frequency spectral data but an encoded data stream is inputted into the extended decoding unit 801. A structural difference from the first embodiment is only the extended decoding unit 801, so only the operation thereof will be explained below. The parameters indicating the harmonic structure analyzed by the harmonic structure analyzing unit 701 shown in FIG. 7 are stored in an area of the encoded data stream which is inputted into the extended decoding unit 801. The area is not recognized as an encoded audio data stream by the core decoding unit 102. In the stage (not shown in this figure) previous to the decoding device 800, a processing unit is provided for extracting parameters indicating the harmonic structure from the area of the inputted encoded data stream, and the decoding unit 802 of the extended decoding unit 801 decodes the parameters extracted by the processing unit. The harmonic generating unit 803 generates the extended spectral data having the harmonic structure in the higher frequency region of each frame based on the parameters decoded by the decoding unit 802.

Figure 10:
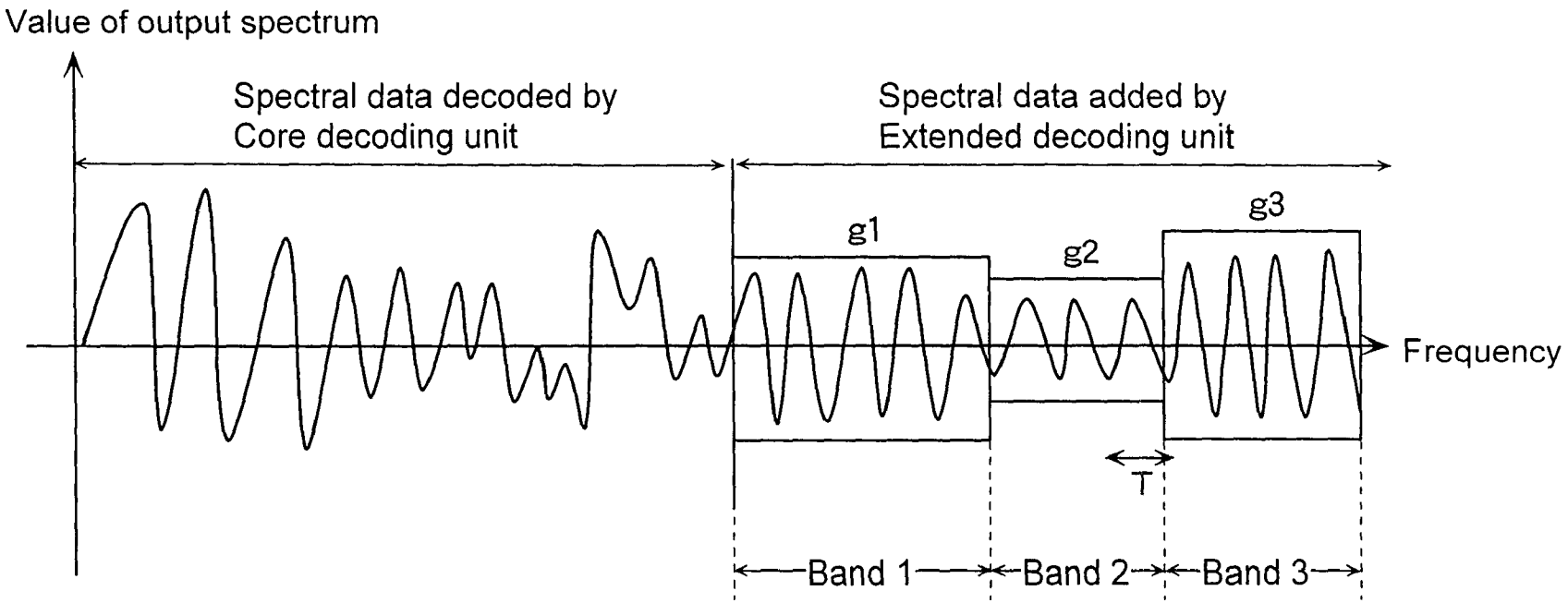
FIG. 10 is a diagram showing an example of extended spectral data which is generated by a harmonic generating unit shown in FIG. 9.

FIG. 10 is a diagram showing an example of the extended spectral data which is generated by the harmonic generating unit 803 shown in FIG. 9. Each waveform shown in FIG. 10 is not an analog waveform but a digital one. The same applies to the following diagrams showing waveforms. FIG. 10 shows the case where the number of the bands which are decoded by the decoding unit 802 is 3, a band 1, a band 2 and a band 3, and the values of the average amplitude (band gain) of respective bands are g1, g2 and g3. Here, the harmonic cycle "T" of the extended spectral data is a predetermined fixed value, and the phase is determined in the same manner as the first embodiment. As described above, according to the decoding device 800 of the second embodiment, the extended decoding unit 801 generates additionally the extended spectral data in the higher frequency region according to the band gains acquired from the encoding device 700 so as to generate the higher spectrum which is closer to the original sound. Therefore, more natural and wider-band reproduced sound can be obtained from a small amount of the input encoded data stream.

In the encoding device 700 and the decoding device 800 of the second embodiment, the encoding device 700 transfers only the band gain of each band in the higher frequency region of each frame as a parameter indicating a harmonic structure to the decoding device 800. However, the present invention is not limited to this, and the encoding device 700 may also transfer the harmonic cycle "T", the offset and the like of the frequency spectral data in the higher frequency region as parameters. In this case, the harmonic structure analyzing unit 701 detects the harmonic cycle "T" and the offset in the same manner as that of the extended decoding unit 104 which has been explained in the first embodiment.

Also, although the number of the bands in the higher frequency region in this case is 3, the present invention is not limited to this, and any number of bands may be used for the higher frequency region. In addition, how to divide the higher frequency region into bands does not need to conform to the standard such as MPEG-2 AAC, but the encoding device 700 and the decoding device 800 may determine appropriate number of bands.

THE THIRD EMBODIMENT

Figure 11:
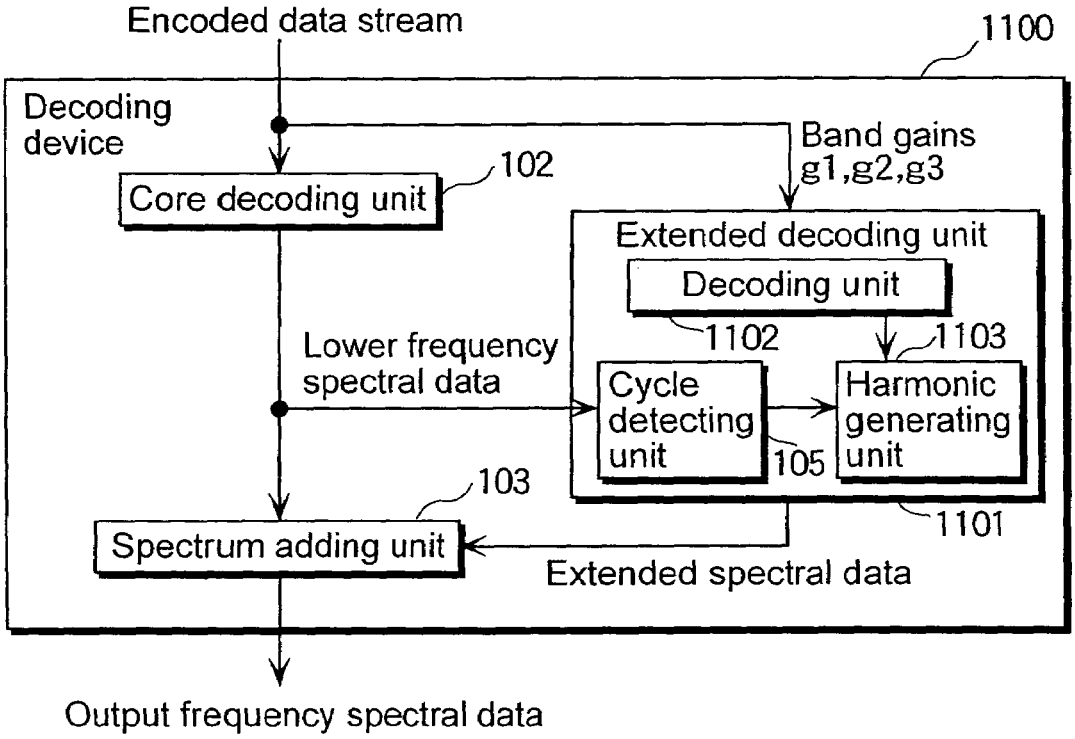
FIG. 11 is a block diagram showing the structure of a decoding device according to a third embodiment.

FIG. 11 is a block diagram showing the structure of a decoding device 1100 according to the third embodiment. The decoding device 1100 is made up of the core decoding unit 102, the spectrum adding unit 103 and an extended decoding unit 1101. The extended decoding unit 1101 includes the cycle detecting unit 105, a decoding unit 1102 and a harmonic generating unit 1103. The third embodiment is different from the first and second embodiments in that frequency spectral data and an encoded data stream are inputted into the extended decoding unit 1101. Therefore, the operation of the extended decoding unit 1101 will be described below.

The encoded data stream which is inputted into the extended decoding unit 1101 is a coefficient (band gain) corresponding to average amplitude of each band which consists of a plurality of frequency spectral data in the frequency bandwidth decoded by the core decoding unit 102 (the lower frequency region). The conventional encoding device 300 may output this encoded data stream to the decoding device 1100. The decoding unit 1102 of the extended decoding unit 1101 decodes the inputted encoded data stream, reads out the band gain of each band in the lower frequency region, and selects the appropriate band gain out of them or calculates the band gain corresponding to each band in the higher frequency region. For example, the decoding unit 1102 selects a band gain of a band to which a local peak indicating a harmonic structure in the lower frequency region belongs so as to make it the average amplitude of each band in the higher frequency region. Or, the decoding unit 1102 divides the lower frequency region into new larger bands which are appropriate to the higher frequency region and averages band gains of a band, to which a local peak indicating a harmonic structure belongs, in the new band appropriate to the higher frequency region, so as to make it the average amplitude of each band in the higher frequency region. The frequency spectral data inputted into the extended decoding unit 1101 is the frequency spectral data decoded by the core decoding unit 102, and the cycle detecting unit 105 extracts the harmonic structure (harmonic cycle "T") from this frequency spectral data. The harmonic structure is extracted in the same manner as that described in the first embodiment. The harmonic generating unit 1103 outputs extended spectral data having a harmonic structure, whose harmonic cycle "T" is that detected by the cycle detecting unit 105 and whose average amplitude of each band in the higher frequency region is the band gain obtained from the decoding unit 1102.

As described above, the decoding device 1100 of the third embodiment generates the extended spectral data based on the band gains of the lower bands obtained from the encoded data stream. Therefore, there is no need to provide a new component in the encoding device for detecting band gains in the higher frequency spectral data which is not encoded, and wider-band and more natural reproduced sound can be obtained from a small amount of encoded data stream.

In the third embodiment, the extended decoding unit 1101 handles a plurality of frequency data out of the inputted encoded data stream as one band, and reads out the band gain that is a coefficient corresponding to the average amplitude of that band. However, the extended decoding unit 1101 does not always need to read it out, and a processing unit for extracting the band gain from the inputted encoded data stream may be provided in the stage previous to the decoding device 1100.

Furthermore, in the third embodiment, the band gain in the lower frequency region obtained from the encoded data stream is made the average amplitude of each band in the higher frequency region, but the present invention is not limited to this. As described in the second embodiment, the band gain in the higher frequency region may be acquired directly from the encoded data stream generated by the encoding device 700.

In the third embodiment, the extended decoding unit 1101 extracts a harmonic structure from the lower frequency spectral data and generates extended spectral data whose average amplitude of each band in the higher frequency region is the band gain in the lower frequency region obtained from the encoded data stream. However, the present invention is not limited to this, the extended decoding unit 1101 may receive the lower frequency spectral data and the encoded data stream which are the same as those as mentioned above so as to generate the extended spectral data which is same as that in the lower frequency region. In this case, the cycle detecting unit 105 is not required.

More specifically, the data obtained from the encoded data stream which is inputted into the extended decoding unit 1101 is a coefficient "g(j)" corresponding to the average amplitude (band gain) of the band which is made up of a plurality of frequency spectral data in the frequency bandwidth decoded by the core decoding unit 102 (lower frequency region). The frequency spectral data is the frequency spectral data "sp(j)" decoded by the core decoding unit 102. The harmonic generating unit 1103 creates the normalized frequency spectral data "nor_sp(i)" as shown in Expression 3 from the frequency spectral data "sp(j)". In the normalized frequency spectral data, one band is made up of a plurality of frequency spectral data "sp(j)", and the phase and relative amplitude value of the frequency spectral data in the band are held, and the energy of the frequency spectrum in the band is "1".

$$ng(j) = \frac{1}{\sum sp(i) * sp(i)} \qquad \text{Expression 2}$$

$$nor_sp(i) = ng(j) * sp(i) \qquad \text{Expression 3}$$

In Expression 2, "sp(i)" is the value of the "i"th frequency spectral data, and "ng(j)" is the energy of the frequency spectral data in the band "j" and a normalization coefficient. "Nor_sp(i)" is the normalized frequency data. If the value corresponding to the average amplitude in the band obtained by decoding the encoded data stream in the decoding unit 1102 is "g(j)", the extended spectral data "ex_sp(i+ex_offset)" that is the output of the extended decoding unit 1101 is expressed by Expression 4.

$$ex_sp(i+ex_offset) = g(j) * nor_sp(i) \qquad \text{Expression 4}$$

In Expression 4, "ex_offset" is a value (an integer) indicating a frequency deviation between frequency spectral data and extended spectral data. For example, when the frequency spectral data consists of 512 pieces of data, the maximum 512 pieces of extended spectral data can be generated in the higher frequency region if "512"is fixedly selected as "ex_offset". Furthermore, by adding the frequency spectral data in the lower frequency region and the extended spectral data on the frequency axis, 1024 pieces of output frequency spectral data can be obtained. "ex_offset" may be a fixed value or a variable one. In the above example, the data obtained from the encoded data stream inputted into the extended decoding unit 1101 is a coefficient "g(j)" corresponding to the average amplitude (band gain) in the band which is made up of a plurality of lower frequency spectral data. In this case, the band gain "g(j)" of each band in the higher frequency region may be acquired from the inputted encoded data stream. Also, when the band gain "g(j)" of each band in the lower frequency region is used as in the above example, the band gain "g(j)" in the lower frequency region is not applied as it is to each band in the higher frequency band, but may be used as a band gain for each band in the higher frequency region after being adjusted with a predetermined coefficient. Also, in this example, the normalized frequency spectral data "nor_sp(i)" is obtained from the lower frequency spectral data, but the present invention is not limited to this. For example, the space between the frequency spectral data which are cyclic peaks in the higher frequency region may be interpolated by the frequency spectral data generated on a random basis so that the average energy of the frequency spectral data in the band becomes "g(j)", so as to generate the extended spectral data.

According to the decoding device 1100 as structured as above, the frequency spectral data which is similar to the lower frequency spectral data can be generated in the higher frequency spectral data using the band gain obtained from the encoded data stream and the frequency spectral data decoded by the core decoding unit 102. Therefore, wider-band reproduced sound can be obtained from a small amount of encoded data stream.

THE FOURTH EMBODIMENT

Figure 12:
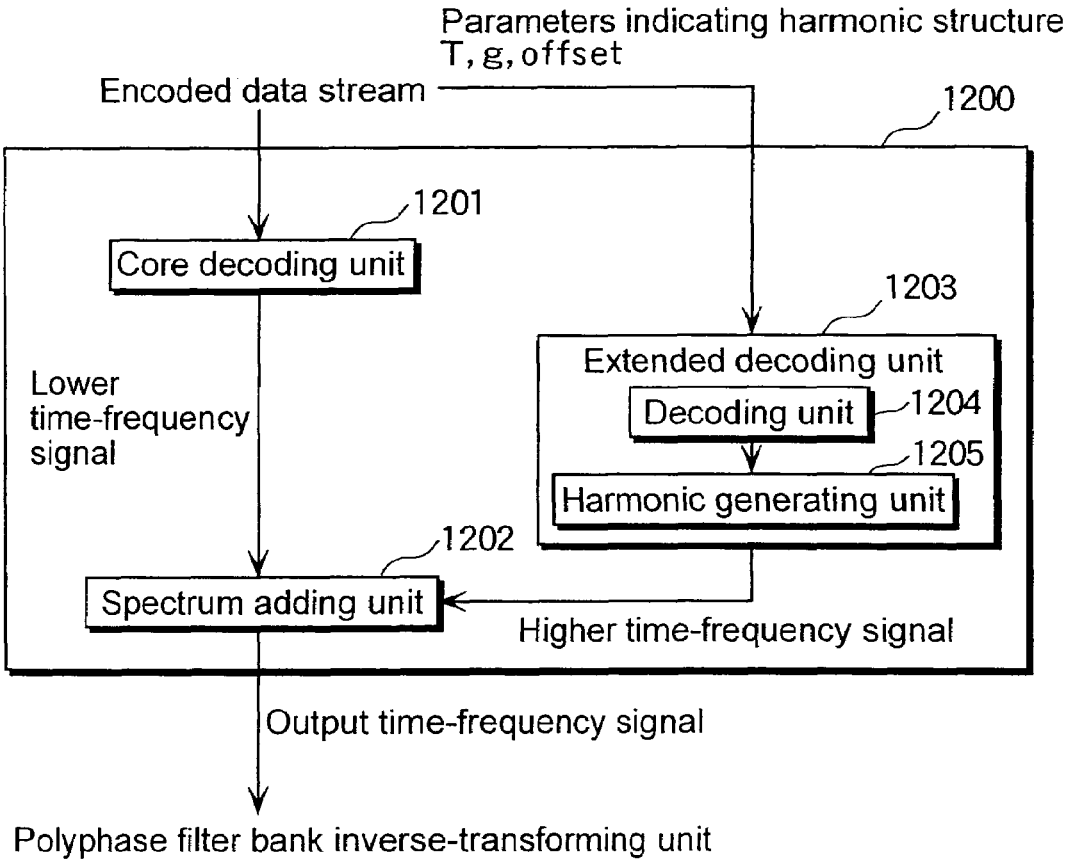
FIG. 12 is a block diagram showing the structure of a decoding device according to a fourth embodiment which decodes time-frequency signals outputted from a filter of a polyphase filter bank.

FIG. 12 is a block diagram showing the structure of a decoding device 1200 according to the fourth embodiment which decodes a time-frequency signal outputted from a filter of a polyphase filter bank. The decoding device 1200 of the fourth embodiment is different from the decoding devices of the above-mentioned first, second and the third embodiments in that the decoding device 1200 decodes a discrete audio signal using a time-frequency signal outputted from the filter of the polyphase filter bank or the like. The decoding device 1200 includes a core decoding unit 1201, a spectrum adding unit 1202 and an extended decoding unit 1203. The extended decoding unit 1203 further includes a decoding unit 1204 and a harmonic generating unit 1205. The encoding device which outputs the encoded bit stream to the decoding device 1200 of the fourth embodiment requires a new component corresponding to the harmonic structure analyzing unit 701 of the encoding device 700 shown in FIG. 7, such as a cyclicity analyzing unit. The cyclicity analyzing unit of the fourth embodiment analyzes the cyclicity in time transition of the spectral values in the higher band based on the time-frequency signal in the higher band, extracts the band gain data "g", cycle data "T" and phase data "offset", encodes these extracted data indicating the cyclicity in time transition of the spectral values, and stores them in an area of the encoded bit stream which is skipped by the conventional decoding device according to the standard. In addition, the encoding device of the fourth embodiment is different from the encoding device 700 shown in FIG. 7 in that the former encodes filter output of a polyphase filter bank or the like.

In the decoding device 1200 structured as above, the core decoding unit 1201 decodes the time-frequency signal in the lower frequency region, that is, the filter output of the polyphase filter bank, out of the inputted encoded bit stream. The core decoding unit 1203 decodes parameters indicating the cyclicity in time transition of the spectral values of the time-frequency signal in each higher band, and generates the extended time-frequency signal having the cyclicity in time transition of the spectral values in the higher frequency region according to the decoded parameters. The decoding unit 1204 extracts the band gain data "g", cycle data "T", phase data "offset" which are the parameters for each higher frequency band (hereinafter referred to as "band") from the area in the encoded bit stream inputted by the extended decoding unit 1203, for decoding them. The area is skipped by the core decoding unit 1201, as mentioned above. Based on the decoded parameters indicating the cyclicity in time transition of the spectral values, the harmonic generating unit 1205 generates an extended time-frequency signal in the higher frequency region. The spectral adding unit 1202 adds the lower time-frequency signal and the higher extended time-frequency signal which are respectively inputted by the core decoding unit 1201 and the extended decoding unit 1203 so as to generate an output time-frequency signal. The output time-frequency signal generated as above, which is the wide-band time-frequency signal of which higher region is interpolated with the extended time-frequency signal, is further transformed into a discrete audio signal on the time axis by a polyphase filter band inverse-transforming unit which is provided in the stage subsequent to the present decoding device 1200.

The following methods are generally used for encoding audio signals: ① Parameters of a discrete audio signal to be inputted are quantized and encoded as a signal in the time domain using various types of filter processing; (② A signal in the time domain is orthogonally transformed at a time into a frequency spectrum by each frame like MDCT, and the frequency spectrum is quantized and encoded; ③ A signal is divided into a plurality of bands using a polyphase filter bank, and a signal indicating the time transition of the frequency spectrum of each band is quantized and encoded, and so on. Since a polyphase filter bank is well known to those skilled in the art, it will be briefly explained below using FIG. 13.

Figures 13A, 13B, 13C:
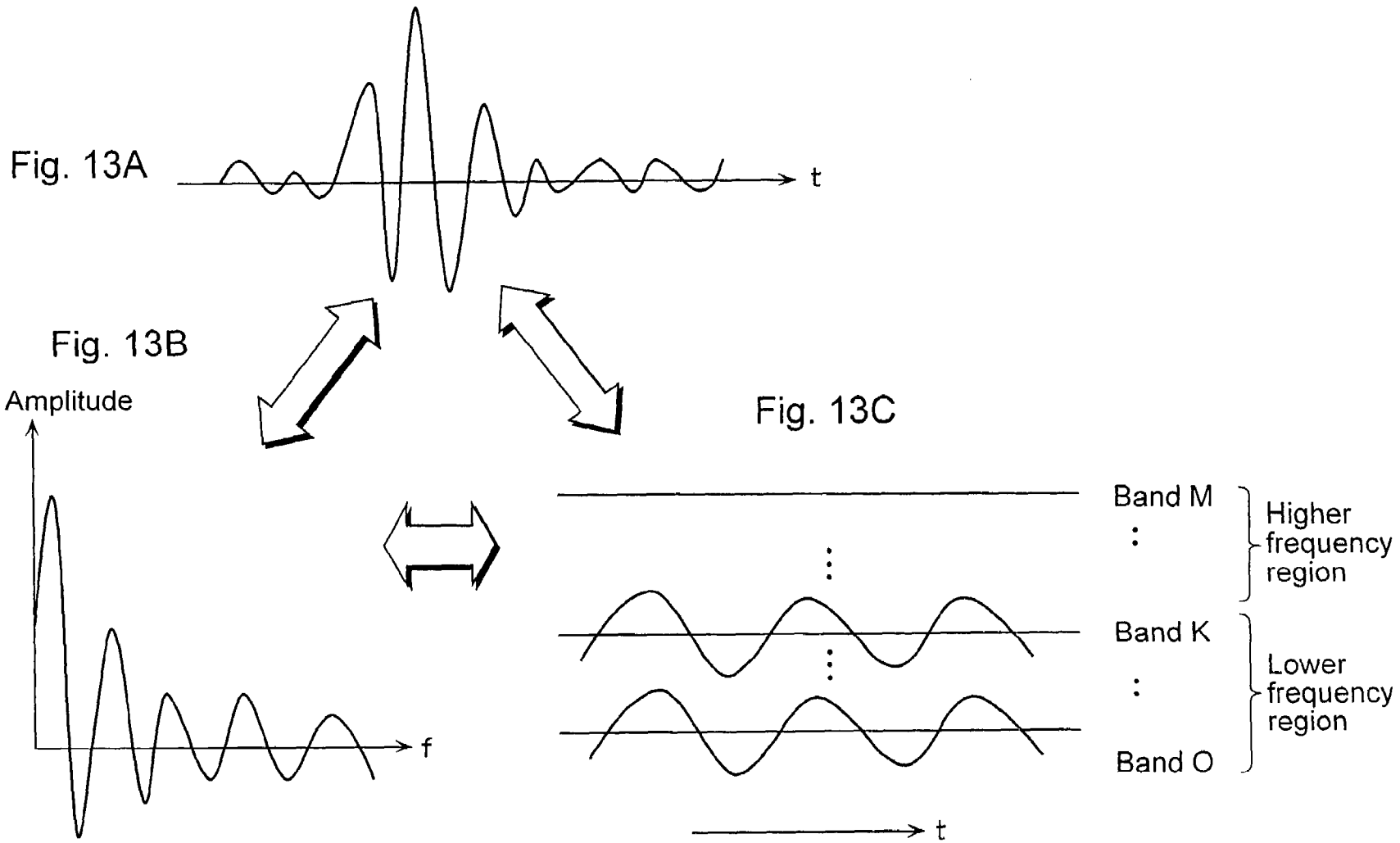
FIG. 13A is a diagram showing a discrete audio signal on the time axis.
FIG. 13B is a diagram showing a frequency spectrum obtained by transforming at a time the discrete audio signal on the time axis into that on the frequency axis using MDCT.
FIG. 13C is a diagram showing time transition of frequency spectrums in plural bands, which are obtained from the discrete audio signal using the polyphase fileter bank.

FIG. 13A to 13C are diagrams showing a discrete audio signal on the time axis and frequency spectral data after time-frequency transform. FIG. 13A is a diagram showing a discrete audio signal on the time axis. In FIG. 13A, the horizontal axis indicates elapsed time and the vertical axis indicates strength of the signal. FIG. 13B is a diagram showing a frequency spectrum obtained by transforming at a time the discrete audio signal on the time axis into that on the frequency axis using MDCT. In FIG. 13B, the horizontal axis indicates frequency transition and the vertical axis indicates amplitudes of the frequency spectral data (spectral values). FIG. 13C is a diagram showing time transitions of frequency spectrums in plural bands which are obtained from the discrete audio signal on the time axis using a polyphase fileter bank. In FIG. 13C, the horizontal axis indicates elapsed time and the vertical axis indicates amplitudes of frequency spectral data (spectral values). The frequency spectrum shown in FIG. 13B is obtained by dividing in every frame time the discrete audio signal on the time axis shown in FIG. 13A into samples for one frame, 1024 samples, for instance, and orthogonally transforming these 1024 samples at a time. Therefore, the waveform of the frequency spectrum shown in FIG. 13B is obtained by plotting respective spectral values of the 1024 samples of frequency spectral data, for instance, in a frequency-amplitude plane and connecting respective points thereof.

On the other hand, the time-frequency signals shown in FIG. 13C are obtained in the following manner. One frame time is divided into M+1 (M is a natural number), and the discrete audio signal on the time axis shown in FIG. 13A is divided into 1024/M+1 samples, for instance, in every divided 1/M+1 frame time. Next, these 1024/M+1 samples are orthogonally transformed using MDCT, for instance. As a result, M+1 frequency spectrums are obtained in one frame time. Each of these M+1 frequency spectrums represents a reproduced frequency bandwidth whose maximum frequency is a half of the sampling frequency, just like the frequency spectrum shown in FIG. 13B. The time-frequency signals shown in FIG. 13C are obtained by extracting the frequency spectral data of the same frequency from each of the obtained M+1 frequency spectrums, plotting each of the extracted frequency spectral data on a time-amplitude plane, and connecting the points thereof. Accordingly, in this case, M+1 time-frequency signals are obtained for one frame. The waveform of each time-frequency signal shows the time transition of the spectrum in each band. Therefore, when the higher region of the frequency spectral data included in the input encoded data stream is cut, for example, the waveform of the frequency spectrum does not appear in the higher band M as shown in FIG. 13C but just indicates a fixed value "0". These time-frequency signals are output signals from a polyphase filter bank.

The encoded data stream representing the time-frequency signals generated as above is inputted into the core decoding unit 1201 of the decoding device 1200, and the audio signal is decoded based on the frequency spectral data included in that encoded data stream. As described above, it is also easy to transform the output signals from the polyphase filter bank into a discrete audio signal on the time axis. Here, for example, it is assumed that, out of the frequency spectral data obtained by encoding a discrete audio signal sampled at the sampling frequency 44.1 kHz, the frequency spectral data represented as time-frequency signals in the lower band 0 through band K of 0~11.025 kHz frequencies is included in the encoded data stream inputted into the core decoding unit 1201.

Figure 14:
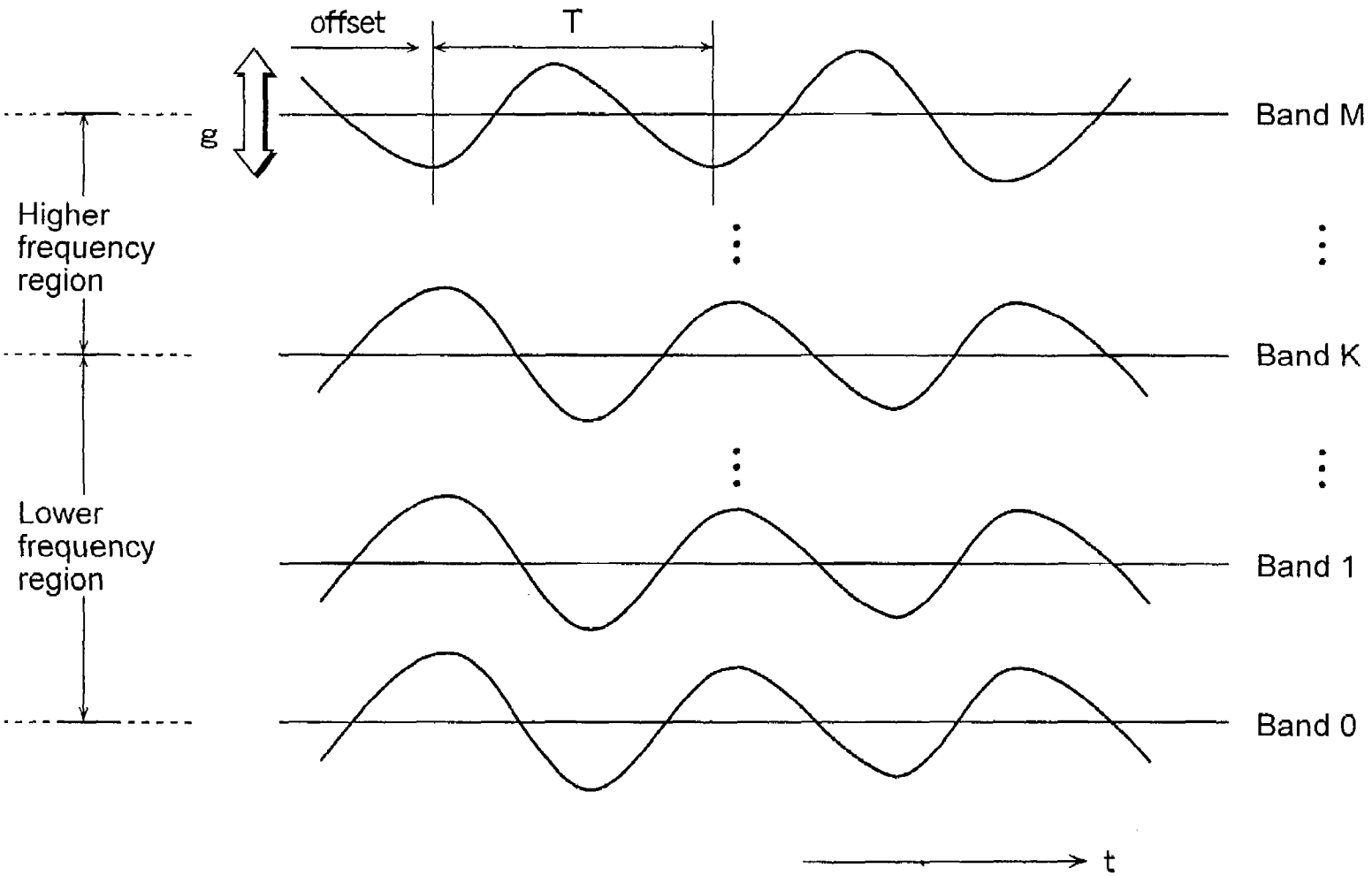
FIG. 14 is a diagram showing a time-frequency signal generated in the higher frequency region by the harmonic generating unit shown in FIG. 12.

The core decoding unit 1203 extracts parameters indicating the cyclicity in time transition of the spectral values of the higher time-frequency signals from the above-mentioned area of the inputted encoded bit stream, and generates the extended time-frequency signals indicating the higher bands of 11.025 kHz or more based on the extracted parameters. FIG. 14 is a diagram showing the time-frequency signals in the entire band including the signal which is generated in the higher frequency region by the harmonic generating unit shown in FIG. 12. The decoding unit 1204 in the extended decoding unit 1203 extracts the parameters indicating the cyclicity in time transition of the spectral values included in the encoded data stream, such as the cycle data "T" corresponding to cyclicity, gain data "g" corresponding to the gain and offset data "offset" of the time-frequency signal waveforms, from the encoded bit stream, and decodes them. Here, in order to simplify the explanation, the case will be described where a set of the parameters "T", "g" and "offset" is extracted by the decoding unit 1204 for every higher band. The harmonic generating unit 1205 generates an extended time-frequency signal which is represented by a cosine function $g*\cos(T*t/2\pi+\text{offset})$ of a cycle "T", an amplitude "g" and a phase "offset" for every higher band, just like the time-frequency signal in the band M shown in FIG. 14, for example.

As described above, according to the decoding device 1200 of the fourth embodiment, an extended time-frequency signal is generated for the higher band using a filter output of a polyphase filter bank. Therefore, a wide-band audio signal with high sound quality and quick response to abrupt changes of the original sound can be reproduced even with a small amount of inputted encoded audio data stream.

Here, the extended time-frequency signal in each higher band is generated using a cosine function, but the present invention is not limited to this, and other functions may be used. Also, the cycle data, gain data, offset data and the like extracted by the decoding unit 1204 do not need to be one set but may be a plurality of sets for one band. For example, when a time-frequency signal in one band is generated, the time-frequency signal may be generated having the cyclicity in time transition of the spectral values which are represented as a different set of cyclicity data "T", gain data "g" and phase data "offset" in a predetermined time period.

Figure 15:
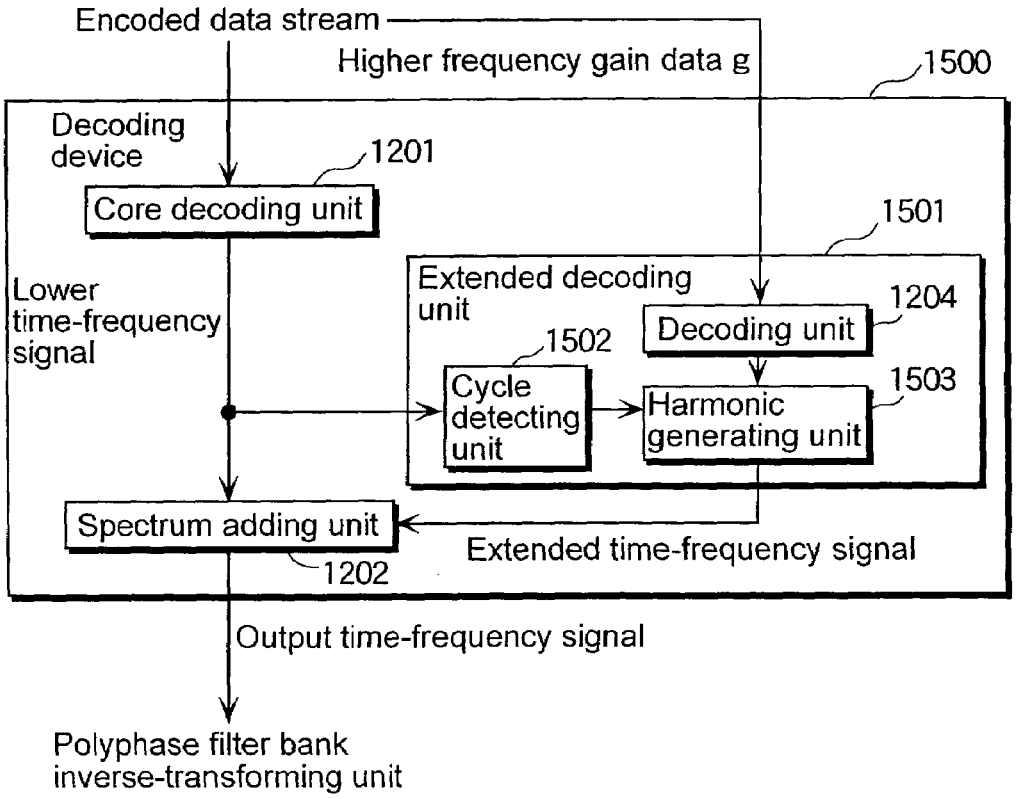
FIG. 15 is a block diagram showing the structure of another decoding device according to the fourth embodiment using the filter output of the polyphase filter bank.

In the fourth embodiment, the extended decoding unit 1203 obtains the parameters "T", "g" and "offset" indicating the cyclicity in time transition of the spectral values of the time-frequency signal in the higher band from the input encoded data stream. However, the present invention is not limited to this, all or a part of the parameters "T", "g" and "offset" indicating the cyclicity in time transition of the spectral values may be extracted from the time-frequency signals in the lower band which are the results of the decoding by the core decoding unit 1201. The case will be explained below where the cycle signal "T" is obtained from the lower time-frequency data which is the result of the decoding by the core decoding unit 1201. FIG. 15 is a block diagram showing the structure of another decoding device 1500 according to the fourth embodiment using a filter output of a polyphase filter bank. The decoding device 1500 includes the core decoding unit 1201, the spectrum adding unit 1202 and an extended decoding unit 1501. The extended decoding unit 1501 further includes the decoding unit 1204, a cycle detecting unit 1502 and a harmonic generating unit 1503. The extended decoding unit 1501 acquires the gain data "g" of each higher band from the input encoded data stream and acquires the cycle "Tp" and phase "offsetp" of each lower band from the lower time-frequency data which is the output of the core decoding unit 1201 so as to generate an extended time-frequency signal in each higher band. The cycle detecting unit 1502 detects the cycle "Tp" and phase "offsetp" of the time-frequency signals in the lower bands using the same method as that used by the cycle detecting unit 105 in the first embodiment. The harmonic generating unit 1503 generates the time-frequency signals in the higher bands using the cycle "Tp" and phase "offsetp" detected by the cycle detecting unit 1502.

Figure 16:
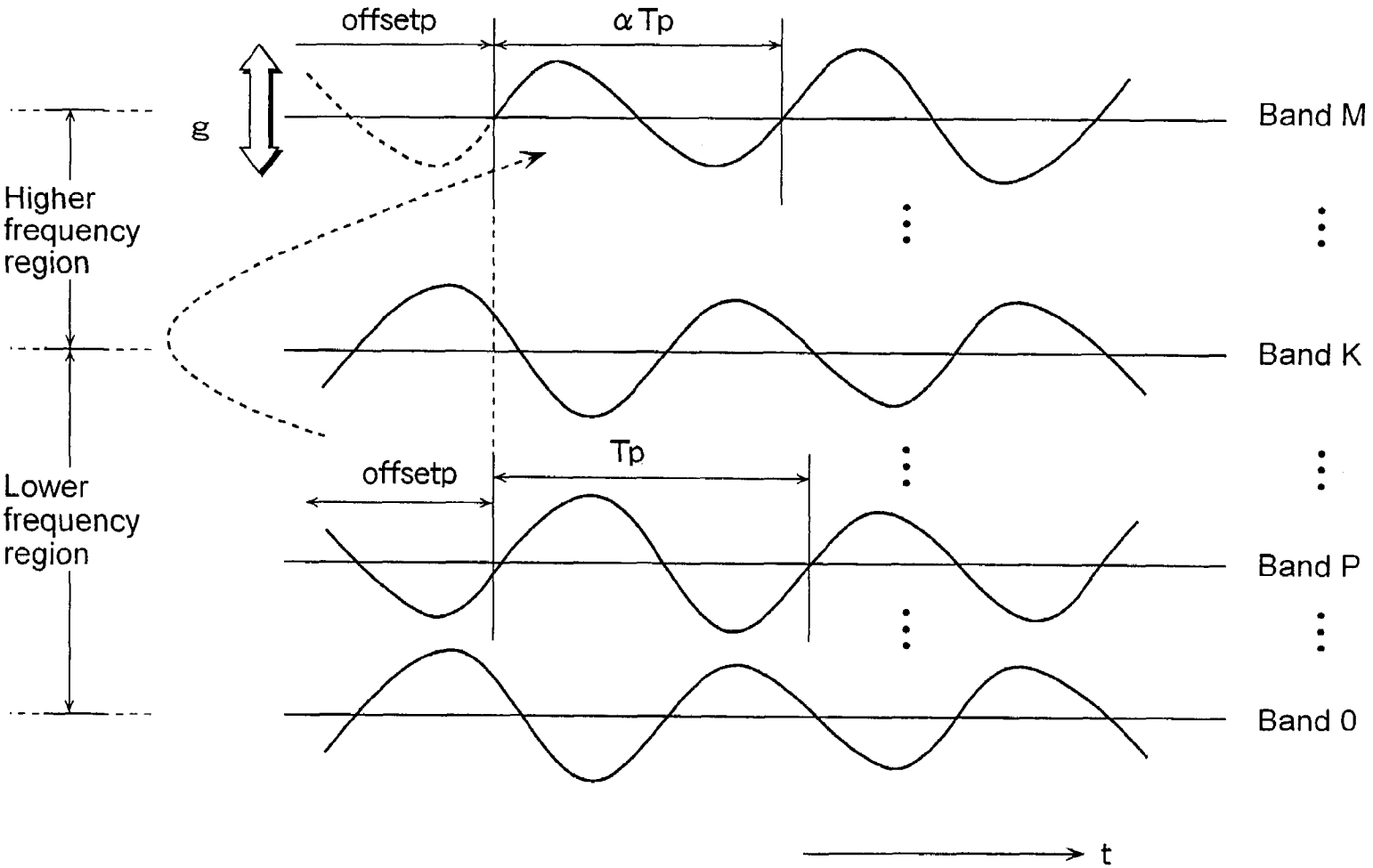
FIG. 16 is a diagram showing an example of time-frequency signals in the lower frequency region and an extended time-frequency signal in the higher frequency region generated by the harmonic generating unit.

FIG. 16 is a diagram showing an example of time-frequency signals in the lower frequency bands and an extended time-frequency signal in the higher frequency band which is generated by the harmonic generating unit 1503. In FIG. 16, the lower time-frequency signals in the band 0 through band K are same as the time-frequency signals shown in FIG. 13C and FIG. 14. The harmonic generating unit 1503 generates the time-frequency signal in the band of higher frequency than the band K, for instance, the band M, using the time-frequency signal in any appropriate band among the band 0 through band K, for instance, the band P. For example, when bands where time-frequency signals have large average amplitudes for every predetermined time period appear at a regular frequency interval in the lower frequency region of a frame, one band which is closest to the band M is selected as the band P from among the bands which appear at the frequency interval. Also, as the band M where the extended time-frequency signal is generated using the time-frequency signal in that band P, a band is selected several intervals away from the band P in the higher frequency region. The harmonic generating unit 1503 multiplies by a predetermined coefficient "α" for adjusting the cyclicity "Tp" of the time-frequency signal in the lower band P detected by the cycle detecting unit 1502, and generates a time-frequency signal having the cycle "α*Tp" in the band M with the start thereof at the offset position of the time-frequency signal in the band P. The harmonic generating unit 1503 further adjust the amplitude with the gain "g" to generate the time-frequency signal for the band M. Here, in the case of α=1, this generation is just transposition, and the time-frequency signal in the band P is copied in the band M with the start at the offset position of the signal in the band P. When the length of the time-frequency signals in the band P and the band M is "L", the time-frequency signal having the length of" α*L" is copied in the band M, but the "offsetp" portion from the start shown by a dotted line is lacking in the signal for the band M. Therefore, the lacking signal for the "offsetp" in the band M is interpolated by copying the signal for the "offsetp" from the start in the band P on the premise that the signal in the band P is repeated at regular intervals.

As described above, even when a filter output of a polyphase filter bank or the like is used in the encoding and decoding process, if the encoding and decoding methods in the first, second and third embodiments are applied to reconstruct the higher frequency components from the lower components with the use of the property that a signal in each bandwidth repeats transitions in strength at regular intervals, the decoding device can reproduce a wide-band audio signal. In the decoding device structured as above, wide-band reproduced sound can be obtained from a small amount of encoded data stream.

Note that the signals decoded by the core decoding unit 102 may be a discrete audio signal stream on the time axis which is easily audible, a frequency spectrum, or a filter output from a polyphase filter bank. They can be transformed into each other by transform or filter processing.

Figure 17:
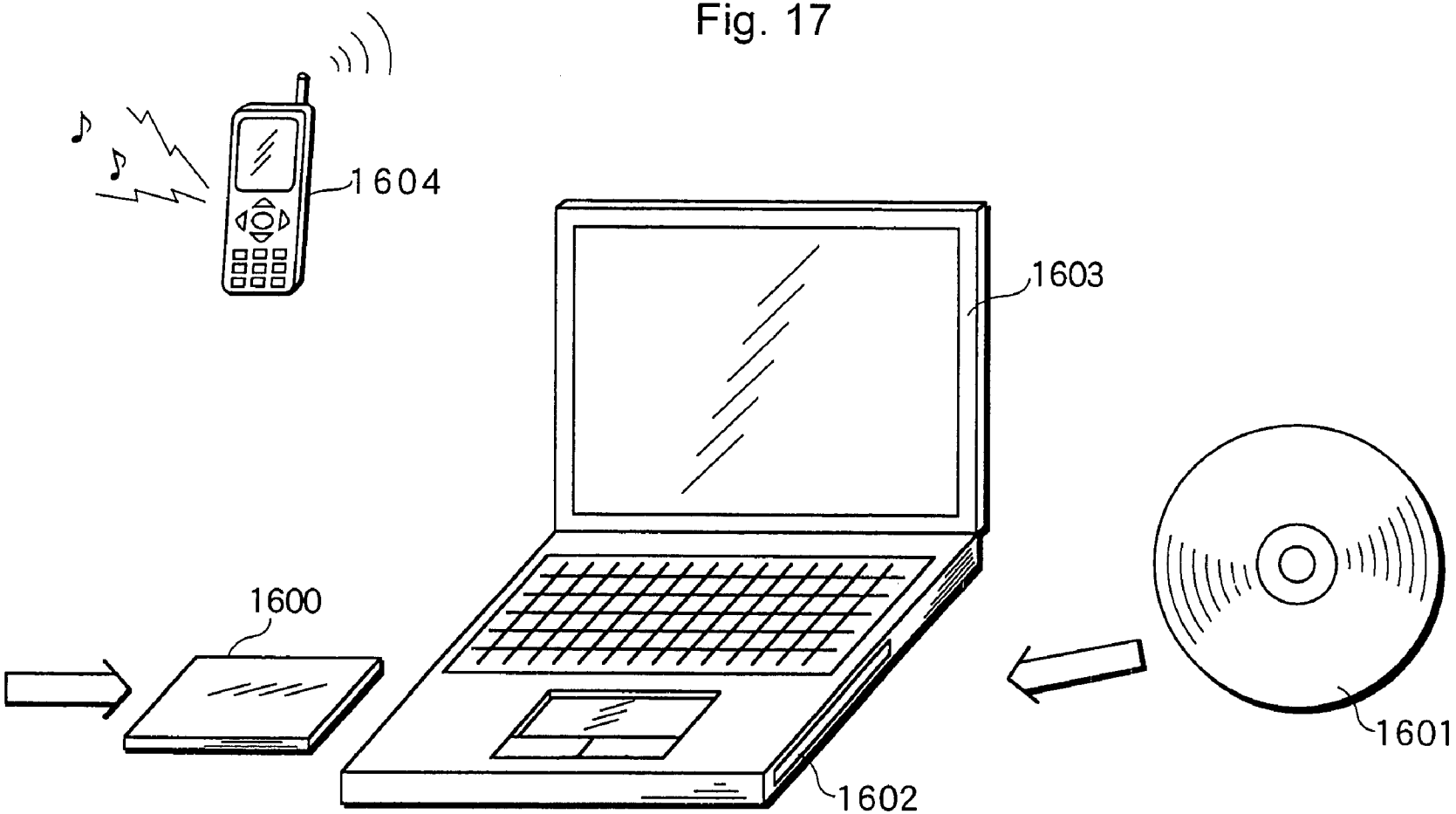
FIG. 17 is a diagram showing the external views of the encoding device and the decoding device of the present invention and a cell phone having the decoding device of the present invention.

FIG. 17 is a diagram showing the external views of the encoding device and the decoding device of the present invention and a cell phone having the decoding device of the present invention. In this figure, an LSI or the like, which is a circuit board in the case where the encoding device and the decoding device of the present invention are realized as hardware only for encoding and decoding audio signals, is integrated into a PC card 1600. If the PC card 1600 is inserted into a card slot not shown in this figure of an STB or a general-purpose personal computer 1603 for encoding and decoding audio signals, wider-band audio signals can be reproduced than before.

A CD 1601 stores an encoding program and decoding program in the case where the encoding device and the decoding device of the present invention are realized as software. If this CD 1601 is set in a CD drive 1602 of the personal computer 1603 and audio signals are encoded and decoded according to the programs which are started up by the setting of the CD 1601, wider-band audio signals can be reproduced than before.

An LSI only for decoding audio signals in the case where the decoding device of the present invention is realized as hardware is integrated into a cell phone 1604. When this cell phone 1604 receives audio signals encoded by the encoding device of the present invention, an encoded bit stream can be transmitted with a relatively small amount of data even via a transmission channel of a low bit rate. If this cell phone 1604 reproduces the received audio signals, it can reproduce wider-band and more natural audio signals than a cell phone including the conventional decoding device.

INDUSTRIAL APPLICABILITY

The encoding device according to the present invention is useful as an audio encoding device which is located in a broadcast station for a satellite broadcasting including BS and CS, as an audio en coding device for a content distribution server which distributes contents via a communication network such as the Internet, and further as a program for encoding audio signals which is executed by a general-purpose computer.

In addition, the decoding device according to the present invention is useful not only as an audio decoding device which is located in an STB at home, but also as a cell phone for reproducing audio signals, a program for decoding audio signals which is executed by a general-purpose computer, and a circuit board, an LSI or the like only for decoding audio signals which is included in an STB or a general-purpose computer, and further as an IC card which is inserted into an STB or a general-purpose computer.

The invention claimed is:

1. A decoding device that generates frequency spectral data from an inputted encoded audio data stream, the decoding device comprising:

a core decoding unit operable to decode the inputted encoded data stream and generate first frequency spectral data representing an audio signal; and an extended decoding unit operable to generate, based on the first frequency spectral data, second frequency spectral data in a frequency region which is not represented by the encoded data stream, wherein the second frequency spectral data has a harmonic structure which is the same as has a harmonic structure of the first frequency spectral data, and wherein the second frequency spectral data is an extension of the first frequency spectral data along a frequency axis.

2. The decoding device according to claim 1, wherein the extended decoding unit includes:

a cycle detecting unit operable to detect a cycle of the harmonic structure of the first frequency spectral data; and a harmonic generating unit operable to generate the second frequency spectral data with a harmonic structure having the cycle detected in the first frequency spectral data.

3. The decoding device according to claim 2, wherein the cycle detecting unit detects the cycle of the harmonic structure using an auto-correlation function of the first frequency spectral data.

4. The decoding device according to claim 2, wherein the harmonic generating unit generates the second frequency spectral data with a predetermined amplitude, and wherein the second frequency spectral data is in a higher frequency region than the first frequency spectral data.

5. The decoding device according to claim 2, wherein the cycle detecting unit further detects a harmonic waveform representing the harmonic structure of the first frequency spectral data, and wherein the harmonic generating unit generates the second frequency spectral data having the same harmonic waveform as the first frequency spectral data, and sets a harmonic offset of the second frequency spectral data so as to maintain continuity between the first frequency spectral data and the second frequency spectral data, the harmonic offset being a phase deviation of the second frequency spectral data for joining the harmonic structure of the first frequency spectral data to the harmonic structure of the second frequency spectral data.

6. The decoding device according to claim 5, wherein the cycle detecting unit detects the cycle from a frequency interval between one peak and a peak adjacent to said one peak in the first frequency spectral data, and detects the harmonic waveform from a form of an amplitude transition in one cycle of the harmonic structure, and wherein the harmonic generating unit sets the harmonic offset based on the detected cycle and a peak at a highest frequency indicating the harmonic structure in the first frequency spectral data.

7. The decoding device according to claim 6, wherein the cycle detecting unit detects the harmonic waveform by making a functional approximation of the harmonic waveform indicating the amplitude transition of the first frequency spectral data in the frequency interval between said one peak and the adjacent peak in the first frequency spectral data.

8. The decoding device according to claim 7, wherein the cycle detecting unit detects the harmonic waveform by making a cosine-functional approximation of the harmonic waveform.

9. A decoding method for generating frequency spectral data from an inputted encoded audio data stream, the decoding method comprising:

a core decoding step of decoding the inputted encoded data stream and generating first frequency spectral data representing an audio signal; and an extended decoding step of generating, based on the first frequency spectral data, second frequency spectral data in a frequency region which is not represented by the encoded data stream, wherein the second frequency spectral data has a harmonic structure which is the same as a harmonic structure of the first frequency spectral data, and wherein the second frequency spectral data is an extension of the first frequency spectral data along a frequency axis.

10. A computer readable recording medium on which a program for a decoding device that generates frequency spectral data from an inputted encoded audio data stream is recorded, the program causing the computer to execute:

a core decoding step of decoding the inputted encoded data stream and generating first frequency spectral data representing an audio signal; and an extended decoding step of generating, based on the first frequency spectral data, second frequency spectral data in a frequency region which is not represented by the encoded data stream, wherein the second frequency spectral data has a harmonic structure which is the same as a harmonic structure of the first frequency spectral data, and wherein the second frequency spectral data is an extension of the first frequency spectral data along a frequency axis.

* * * * *